US012262812B1

(12) United States Patent
Berkowitz

(10) Patent No.: US 12,262,812 B1
(45) Date of Patent: Apr. 1, 2025

(54) APPARATUS AND METHOD FOR A RELEASABLY LOCKED DESKTOP IN A MODULAR CUBICLE

(71) Applicant: Jay A. Berkowitz, Penn Valley, PA (US)

(72) Inventor: Jay A. Berkowitz, Penn Valley, PA (US)

( * ) Notice: Subject to any disclaimer, the term of this patent is extended or adjusted under 35 U.S.C. 154(b) by 0 days.

(21) Appl. No.: 18/830,134

(22) Filed: Sep. 10, 2024

(51) Int. Cl.
*A47B 83/00* (2006.01)
*A47B 21/00* (2006.01)

(52) U.S. Cl.
CPC ..... *A47B 83/001* (2013.01); *A47B 21/00* (2013.01)

(58) Field of Classification Search
CPC ..... A47B 83/001; A47B 21/00; A47B 96/022
USPC ..... 108/42, 108, 143
See application file for complete search history.

(56) References Cited

U.S. PATENT DOCUMENTS 593,828 A 11/1897 Ank
738,847 A * 9/1903 Rummel ..... A47B 96/022 248/273
1,894,145 A 1/1933 Andler
4,198,913 A * 4/1980 Haworth ..... A47B 96/061 108/142
4,660,477 A * 4/1987 Kortering ..... A47B 46/00 108/108
4,791,873 A 12/1988 Towfigh
4,886,236 A * 12/1989 Randall ..... A47B 96/022 211/90.01
5,297,486 A * 3/1994 Herrmann ..... A47B 96/062 248/250
5,340,209 A * 8/1994 Kolbe ..... F25D 25/024 312/334.46
5,348,385 A 9/1994 Berg
(Continued)

FOREIGN PATENT DOCUMENTS

CN 109222407 A 1/2019
CN 111109842 A 5/2020
(Continued)

OTHER PUBLICATIONS

Dual-Trak Shelf System, Knape & Vogt, © 2017, retrieved on Sep. 10, 2024 from https://www.knapeandvogt.com/sites/default/files/OL2309-DT-ShelfSystems-SS-WEB.pdf.

*Primary Examiner* — Jose V Chen
(74) *Attorney, Agent, or Firm* — Caesar Rivise, PC

(57) ABSTRACT

An apparatus and method for a releasably lockable desktop in a modular cubicle. The apparatus includes a pair of support brackets that releasably secure to at least one cubicle wall. Each bracket includes a horizontal flange that includes a plurality of projections thereon. These plurality of projections fit into corresponding chambers in corresponding receptacle brackets that are installed on the bottom of a desktop element. Each receptacle bracket includes a release device with a release button that is compressed and rides along the horizontal flanges of the support brackets. When the desktop element is pulled back towards the user, the release buttons are seated in respective apertures in the support brackets, thereby releasably locking the desktop element on the support brackets. Each support bracket secures to a respective C-shaped mounting bracket that have an upper lip that gets trapped between two respective vertically-stacked cubicle tiles.

21 Claims, 27 Drawing Sheets

(56) References Cited

U.S. PATENT DOCUMENTS 5,405,114 A * 4/1995 Dias ..... A47B 96/061 211/187
5,720,230 A * 2/1998 Mansfield ..... A47F 5/0043 211/DIG. 1
5,735,589 A * 4/1998 Herrmann ..... B29C 45/4407 312/334.44
5,918,422 A * 7/1999 Bucher, Jr. ..... E04B 2/7425 160/159
5,970,887 A * 10/1999 Hardy ..... A47B 46/00 211/187
6,019,331 A * 2/2000 Hoogland ..... A47B 96/061 211/187
6,457,790 B1 * 10/2002 Liang ..... A47B 88/493 312/334.46
6,591,762 B1 * 7/2003 Haghayegh ..... A47B 96/022 108/42
6,799,523 B1 * 10/2004 Cunha ..... A47F 5/0093 108/143
7,255,236 B1 * 8/2007 Sauder ..... A47B 96/027 211/183
7,258,317 B1 * 8/2007 Nagel ..... A47B 96/025 108/143
7,270,385 B2 * 9/2007 Mathur ..... A47B 96/025 108/108
7,311,211 B2 * 12/2007 Chung ..... A47F 5/0093 211/90.02
7,438,002 B2 10/2008 Murray
7,497,344 B2 * 3/2009 Chen ..... A47B 96/028 248/220.42
8,479,664 B2 7/2013 Nelson
8,919,264 B1 12/2014 Lager
8,998,008 B1 * 4/2015 Robertson ..... A47B 96/063 108/42
9,131,771 B2 * 9/2015 Lindblom ..... A47B 96/028
9,173,506 B2 * 11/2015 Andersson ..... A47F 5/0807
9,277,818 B1 * 3/2016 Preston ..... A47B 96/066
9,420,878 B2 8/2016 Lager
10,477,960 B1 11/2019 Johnson
10,487,499 B1 11/2019 Berkowitz
10,495,376 B2 * 12/2019 Roesch ..... F25D 25/027
11,193,273 B2 12/2021 Berkowitz
11,619,043 B2 4/2023 Berkowitz
11,717,085 B2 * 8/2023 Nilsson ..... A47B 96/1441 211/182
12,049,756 B2 7/2024 Berkowitz
2003/0154673 A1 * 8/2003 MacGregor ..... F16M 11/041 52/239
2004/0112258 A1 6/2004 Fichman
2008/0224004 A1 * 9/2008 Gallien ..... A47B 96/066 248/220.1
2013/0320829 A1 12/2013 Dries
2014/0197119 A1 * 7/2014 Stenhouse ..... A47B 96/022 211/90.01
2015/0216366 A1 * 8/2015 Knoll, Jr. ..... A47B 57/045 211/90.01
2015/0292794 A1 * 10/2015 Bienick ..... A47B 96/062 108/42
2016/0007753 A1 * 1/2016 McMillin ..... A47B 55/00 108/42
2016/0095437 A1 * 4/2016 Crandall ..... A47B 96/021 211/90.01
2018/0206641 A1 * 7/2018 Stefenack ..... A47B 96/022
2021/0131117 A1 5/2021 Warner

FOREIGN PATENT DOCUMENTS

CN 112869363 B 5/2022
CN 111887580 B 7/2022
GB 2135867 B 10/1986
GB 2346548 A 8/2000
GB 2372196 A 8/2002
KR 101908714 B1 10/2018
WO WO97/19617 6/1997

* cited by examiner

APPARATUS AND METHOD FOR A RELEASABLY LOCKED DESKTOP IN A MODULAR CUBICLE

BACKGROUND OF THE INVENTION

The present invention relates generally to modular furniture and, more particularly, to an apparatus and method for a releasably securable desktop for coupling within the cubicle.

The use of cantilever brackets for assembling shelves in homes and businesses is well-known. An example of such "brackets and standards" style shelf is shown by the Dual Trak™ Shelf System sold by Knape & Vogt. However, these "brackets and standards" styles are designed for use on walls, not in cubicles.

FIGS. 1A-1B depict a modular business cubicle (MBC) that can be assembled from a plurality of tiles without the need for separate connectors for coupling the tiles together. See U.S. Pat. Nos. 10,487,499; 11,193,273; 11,619,043; and 12,049,756. In particular, the cubicle MBC comprises a plurality of tiles, T, that can be coupled together to form a first tier or level L1 of tiles, upon which a second tier or level L2 of tiles can be releasably secured and upon which a third tier or level L3 of tiles can be releasably secured.

Providing an associated desktop within the assembled cubicle is an important aspect to completing the modular business cubicle. Although there are removable desktops available for connecting within business cubicles, many of these desktops are connected to support brackets using fasteners, e.g., screws or nails. These fasteners can provide significant hazards since the screw or nails (e.g., 1.5") used may be longer than the thickness of the desktops (e.g., 1.25") and thus may pierce the desktop exposing the user to impalement.

Thus, there remains a need to provide for a removable desktop that can be safely, reliably and easily connected within the cubicle for use by workers. Thus, the subject invention addresses that need.

All references cited herein are incorporated herein by reference in their entireties.

BRIEF SUMMARY OF THE INVENTION

A releasable desktop apparatus for use in a modular cubicle formed of a plurality of tiles, some of which are vertically connected, to form at least one wall of the modular cubicle is disclosed. The releasable desktop apparatus comprises: a desktop element having a pair of receptacle brackets inserted on opposite edges of a bottom side of the desktop element, each of the receptacle brackets comprising a plurality of chambers; a first support bracket that releasably secures to the at least one wall, and a second support bracket that releasably secures to the at least one wall, each of the first and second support brackets comprising a plurality of projections corresponding to the plurality of chambers in the receptacle brackets; and a respective release device positioned within each receptacle bracket and each comprising a release button, each of the release buttons configured to ride along a respective horizontal flange of the first and second support brackets when the plurality of projections are inserted within the plurality of chambers in the desktop element and the desktop element is moved until the release buttons encounter and seat within a respective aperture within the respective horizontal flanges, thereby releasably locking the desktop to the first and second support brackets.

A method for making a desktop element releasably lockable in a modular cubicle formed of a plurality of tiles, some of which are vertically connected, to form at least one cubicle wall is disclosed. The method comprises: forming a desktop element having a pair of receptacle brackets inserted on opposite edges of a bottom side of the desktop element, each of the receptacle brackets comprising a plurality of chambers, and each of the receptacle brackets including a respective release device having a release button that can move up and down; forming a first and a second support bracket each comprising a plurality of projections corresponding to the plurality of chambers in the receptacle brackets and each support bracket comprising a horizontal flange with an aperture therein; releasably securing the first support bracket and the second support bracket to the at least one wall; positioning the desktop element such that the plurality of projections of the first and second support brackets are aligned with the plurality of chambers in the pair of receptacle brackets and pressing the desktop element downward to have the plurality of projections enter the plurality of chambers; and pulling the desktop element towards the user to cause the release buttons to seat within respective apertures in the respective horizontal flanges of the first and second support brackets and thereby releasably lock the desktop element to the first and second support brackets.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
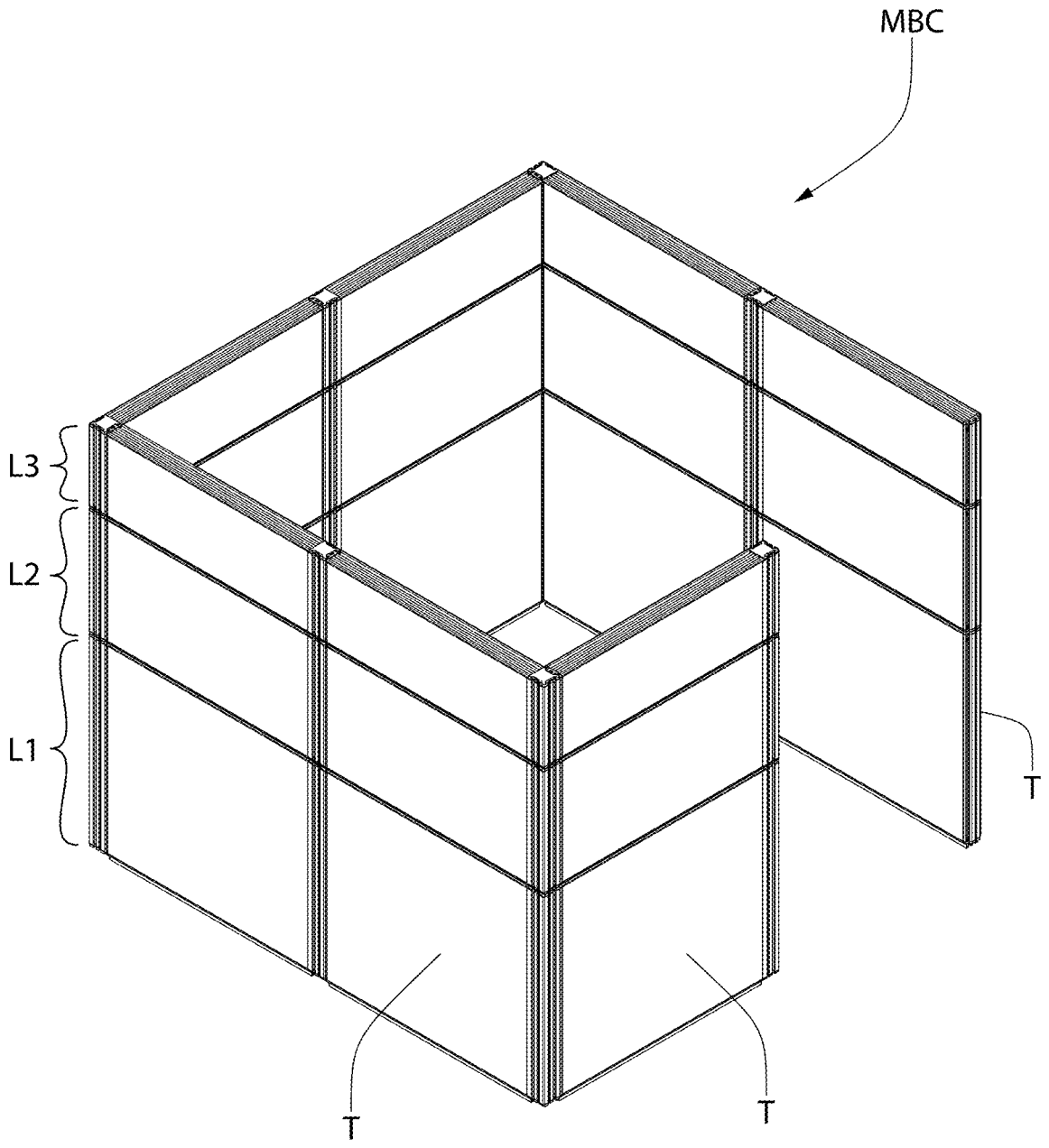
FIG. 1A is an isometric view of a modular business cubicle formed by a plurality of tiles that do not require any separate connectors or tools.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 1B:
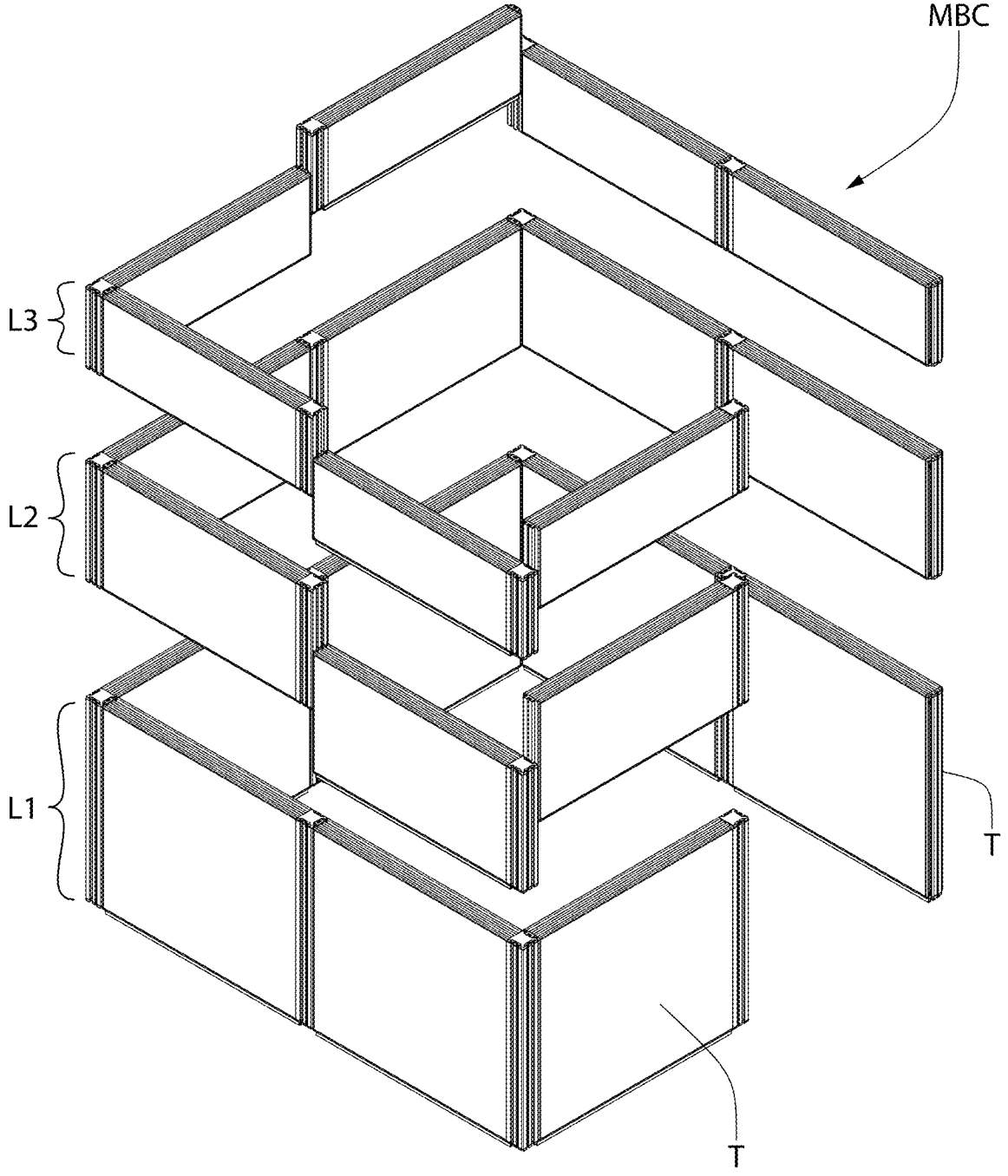
FIG. 1B is an exploded view of the modular business cubicle of FIG. 1A showing the plurality of tiles with built-in tile connectors.
Figure 2:
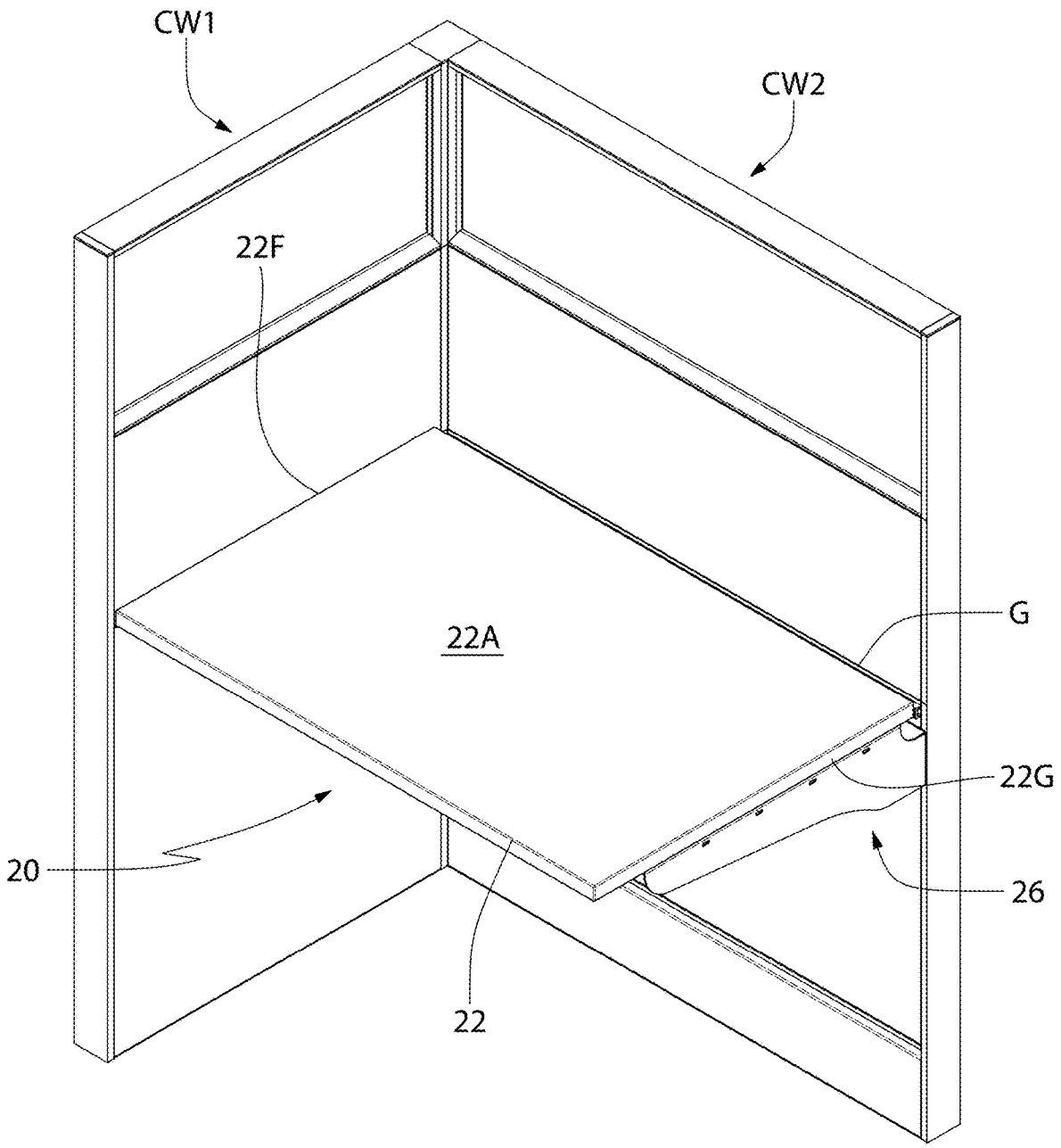
FIG. 2 is a top isometric view of an inside corner of the modular business cubicle showing the inventive releasable desktop apparatus with the desktop element positioned therein and locked in place.
Figure 25:
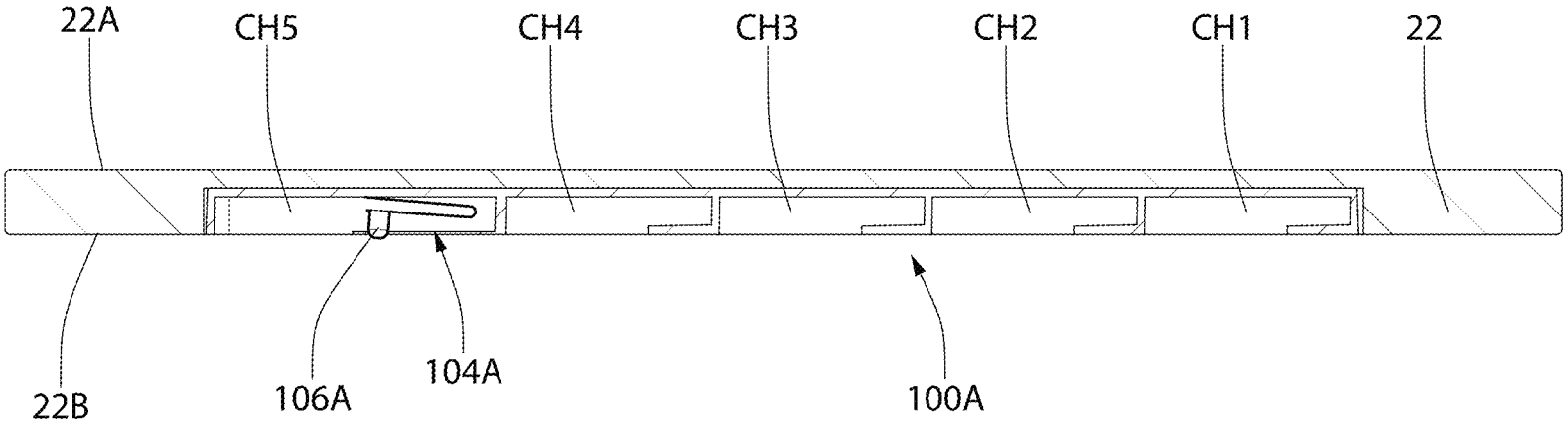
FIG. 25 is a cross-sectional view of the left receptacle bracket taken along line 25-25 of FIG. 24.
Figure 26:
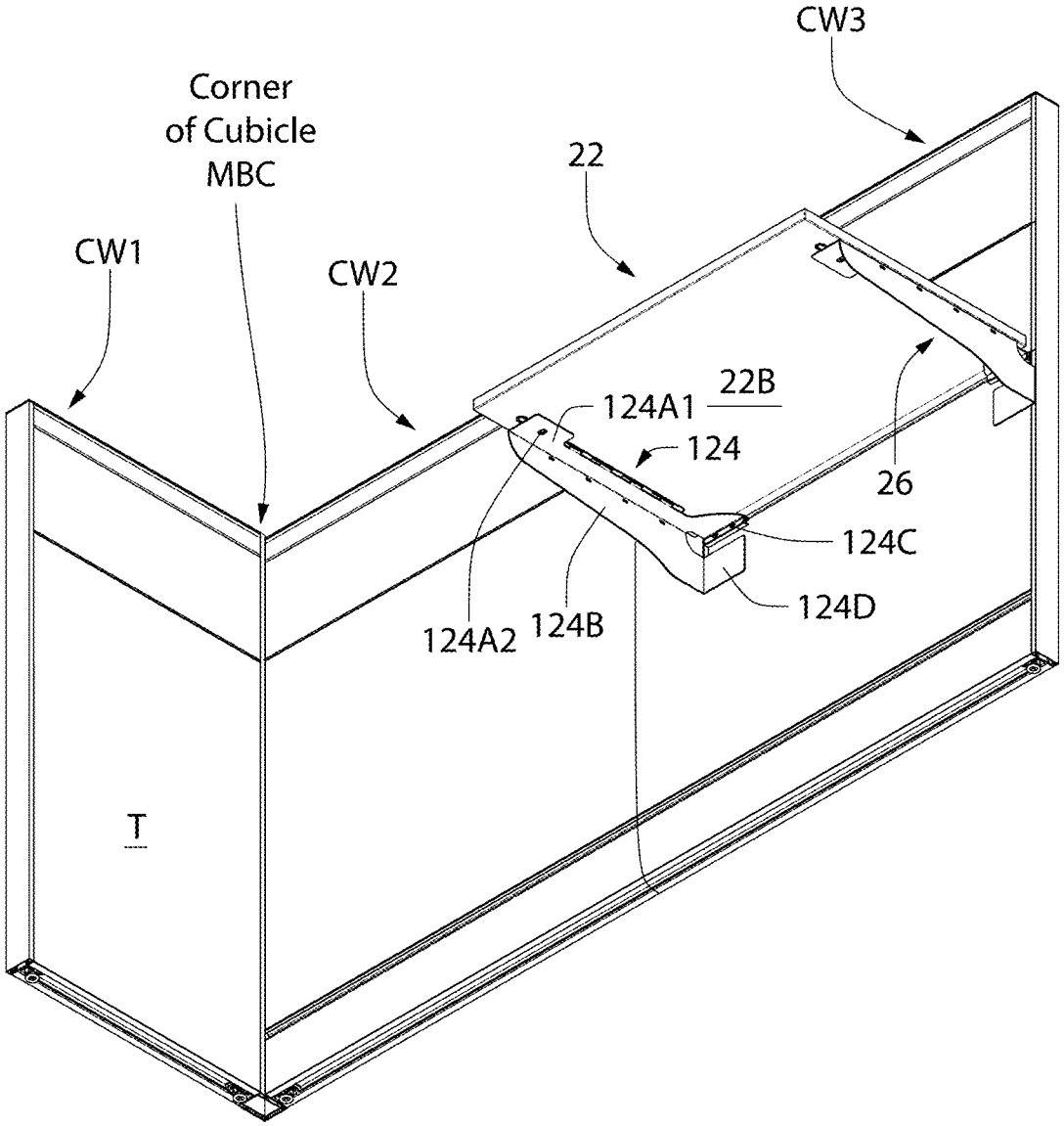
FIG. 26 is an isometric view of the desktop apparatus wherein the left-side and right-side support brackets comprise two cantilever brackets for mounting the desktop element on a cubicle wall not adjacent a cubicle corner.

FIG. 1 depicts the inventive desktop apparatus 20 positioned in a corner of a modular business cubicle (MBC) by way of example only; the apparatus 20 can be used with any type of cubicle having tiles or segments, as will be apparent from the detailed discussion below. FIG. 26 depicts the inventive desktop apparatus 20 positioned on a wall of the cubicle but not adjacent a corner of the cubicle MBC. Thus, FIGS. 2-25 discuss the desktop apparatus 20 being installed within the corner of the cubicle MBC. The desktop apparatus 20 being installed completely along a wall of the cubicle MBC, with the understanding that the left side supporting bracket 124 in FIG. 26 is a "mirror structure" of the right side support bracket 26 but the releasable locking mechanism works the same.

As mentioned above, FIG. 1 depicts the inventive desktop apparatus 20 positioned in the corner but with a desktop element 22 not yet locked in place. As can be seen most clearly in FIG. 3, the desktop apparatus 20 comprises the desktop element 22 having a left side 22F and a right side 22G. Both of these sides are positioned on support brackets 24 and 26 that are releasably coupled to cubicle walls CW1 and CW2, respectively. The left-side support bracket (LSSB) 24 is releasably coupled to cubicle wall CW1 and the right-side support bracket (RSSB) 26 is releasably coupled to cubicle wall CW2, the details of which are discussed later.

As shown most clearly in FIGS. 22-25, the desktop element 22 comprises a top side 22A and a bottom side 22B, a left side 22F and a right side 22G. As shown most clearly in FIGS. 23-24, receptacle brackets 100A and 100B are installed on opposite sides of the bottom side 22B. Liner grooves 22C and 22D are formed into the bottom surface 22B, along the respective sides 22F/22G of the desktop element 22. An adhesive 102A and 102B is applied inside the respective grooves 22C/22D. The receptacle brackets 100A/100B are then fixedly pressed and secured inside the grooves so that the receptable brackets 100A/100B form a smooth contour with the bottom surface 22B. Each receptacle bracket 100A/100B comprises a plurality (e.g., five) serially-aligned chambers, CH1, CH2, CH3, CH4 and CH5. Chambers CH1-CH4 are configured to receive respective L-shaped projections P1, P2, P3 and P4 of the brackets 24/26, as shown most clearly in FIG. 20. Chamber CH5 in each receptacle bracket 100A/100B contains a respective release device 104A and 104B, as discussed next.

Figure 21:
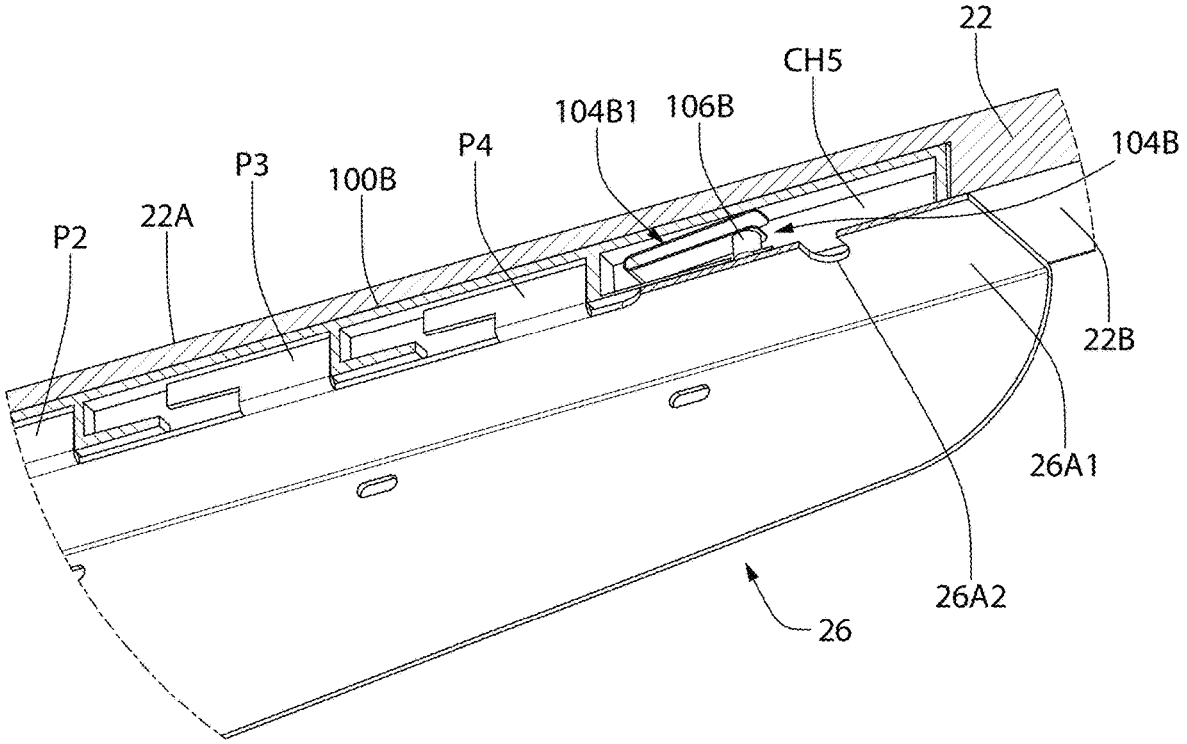
FIG. 21 is a partial cross-sectional isometric view of the right-side support bracket coupled to the right receptacle bracket but not yet locked in place.
Figure 22:
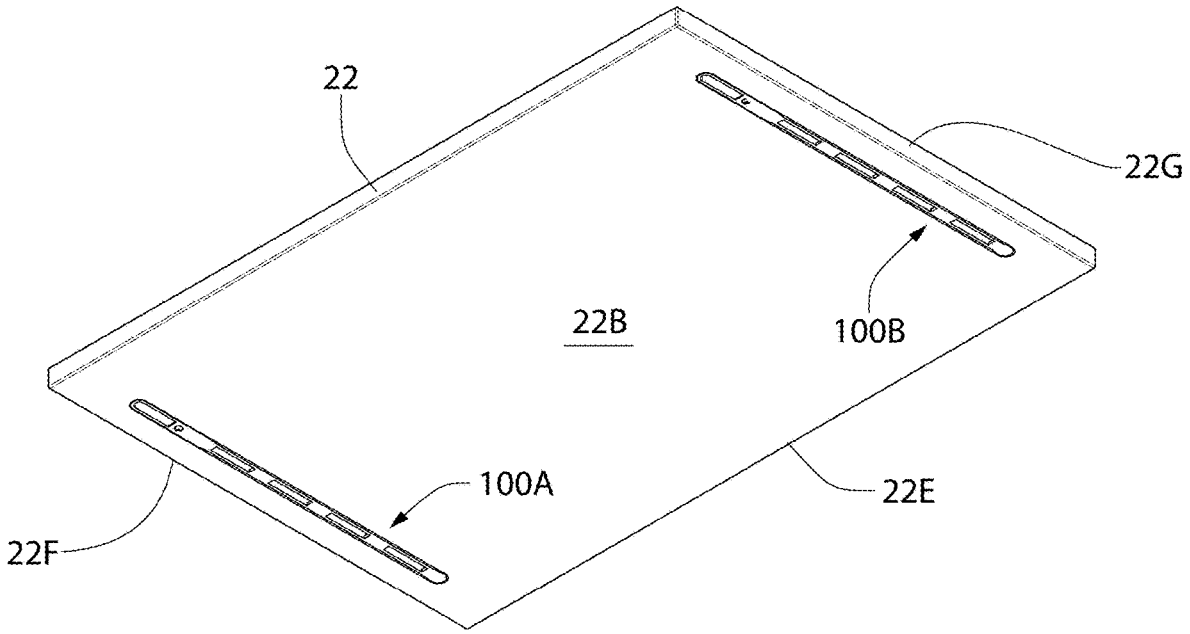
FIG. 22 is an isometric view of the desktop element showing the bottom side.
Figure 23:
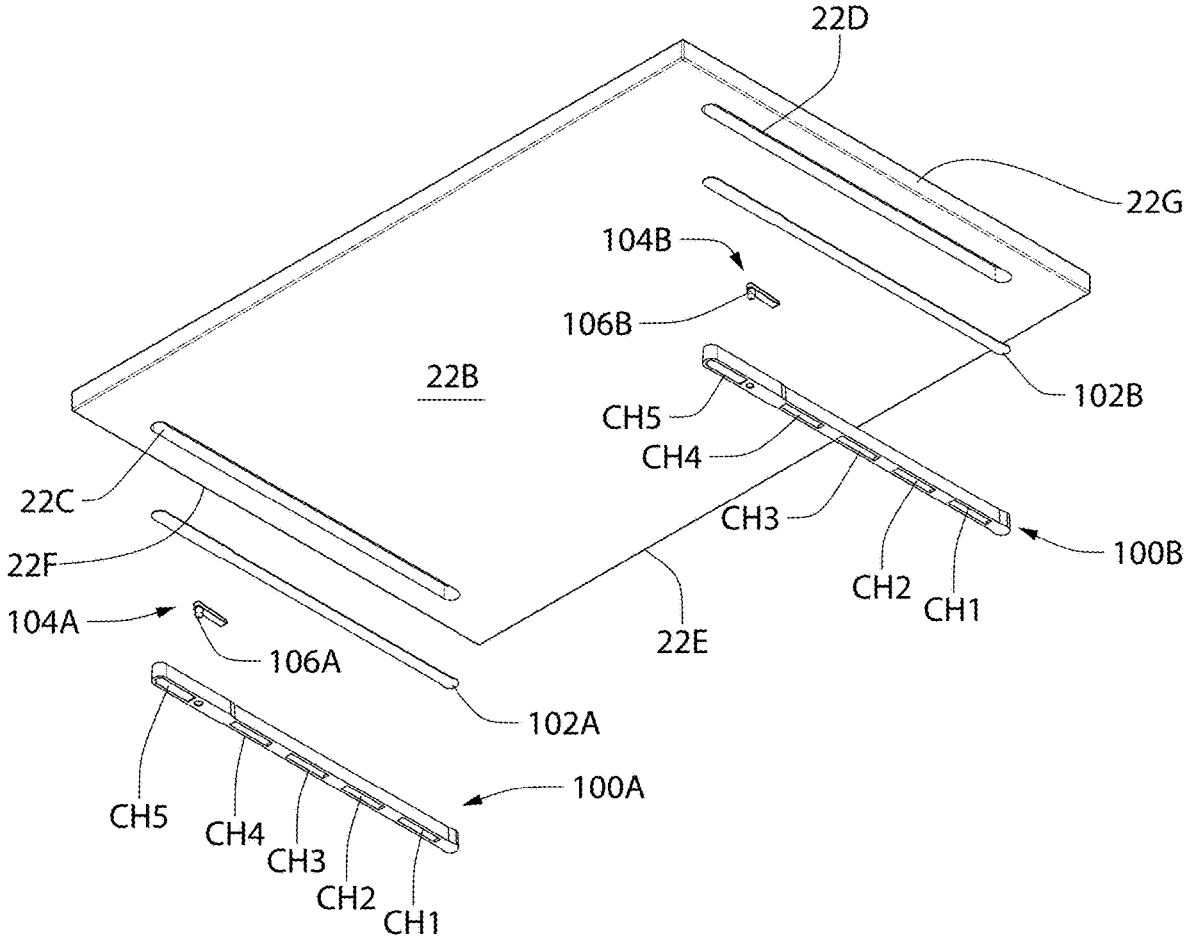
FIG. 23 is similar to FIG. 22 but showing the left and right receptacle brackets in an exploded view.
Figure 24:
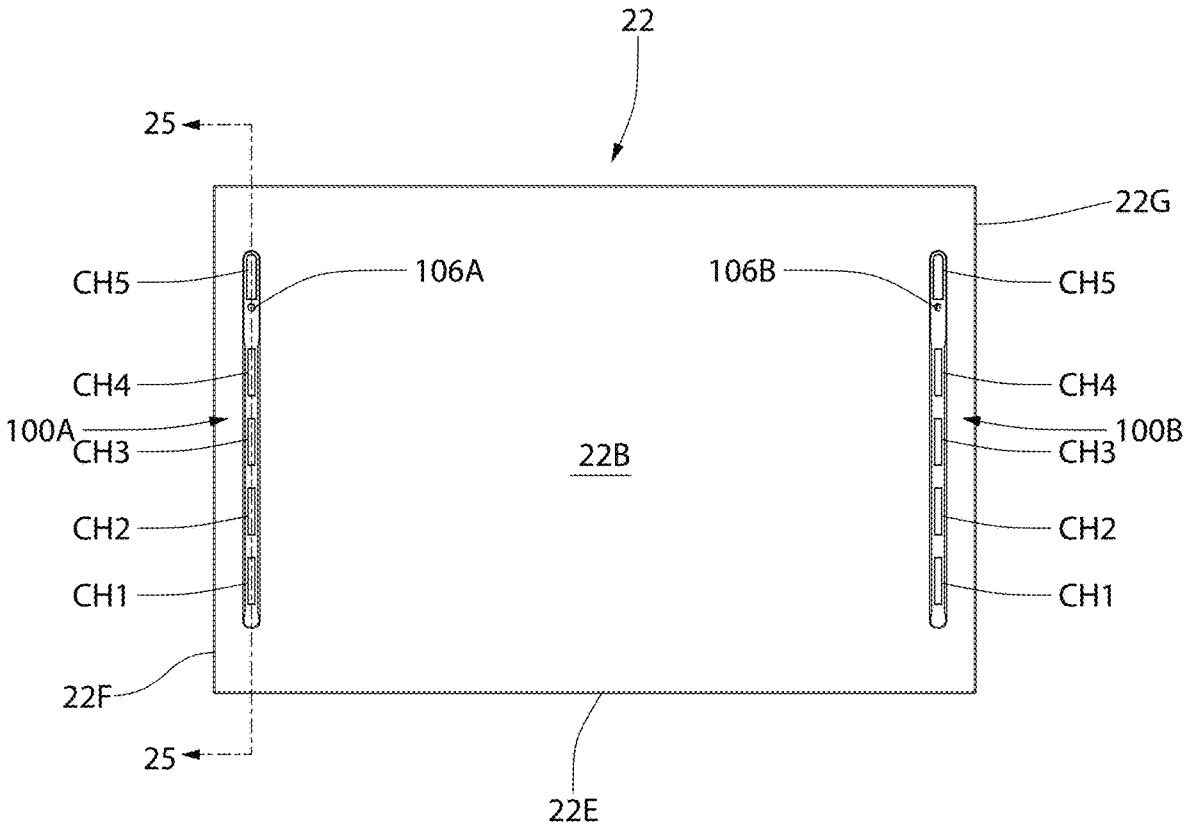
FIG. 24 is a plan view of the bottom side of the desktop element.

Each release device 104A/104B comprises a small leaf spring in a "V-shape" having a corresponding release button 106A/106B on one end of the leaf spring. FIG. 21 depicts release device 104B positioned in chamber CH 5 of receptacle bracket 100B (it being understood that the same goes for the release device 104A in chamber CH5 of the other receptacle bracket 100A). One portion of the "V-shaped" leaf spring 104B1 is secured to an upper wall of the fifth chamber CH5, while the other portion of the V-shaped leaf spring 104B1 having the release button 106B thereon is free to move up and down (similarly, the same goes for the release device 104A, shown in FIG. 25). FIG. 25 is cross-sectional view of the left receptacle bracket 100A, showing the five chambers CH1-CH5, along with the release device 104A secured inside chamber CH5.

The following discussion relates to the left-side support bracket (LSSB) 24 and the right-side support bracket (RSSB) 26.

Figure 3:
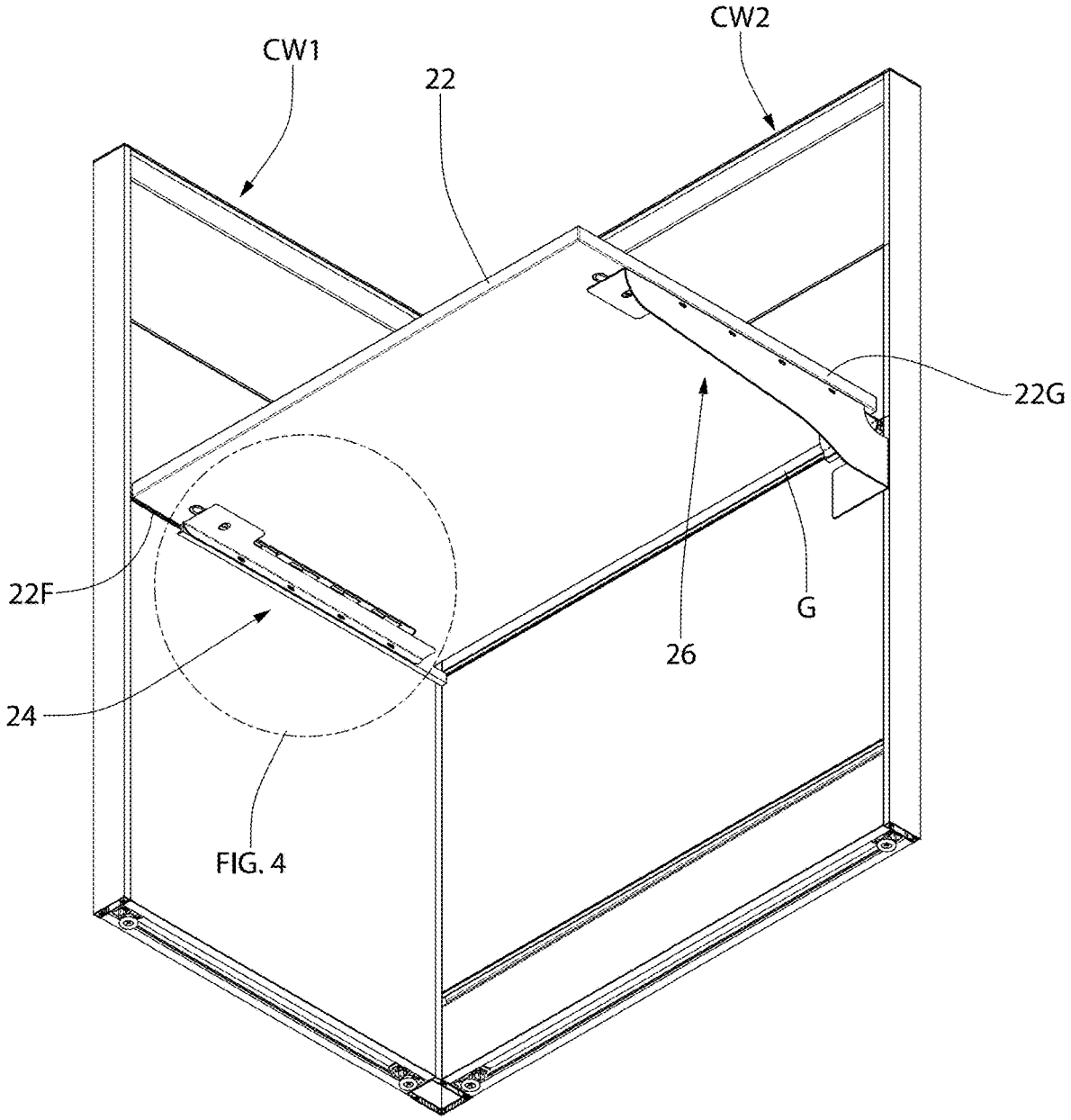
FIG. 3 is a bottom isometric view of an inside corner of the modular business cubicle showing the inventive releasable desktop apparatus of FIG. 2 with the desktop element positioned therein locked in place.
Figure 4:
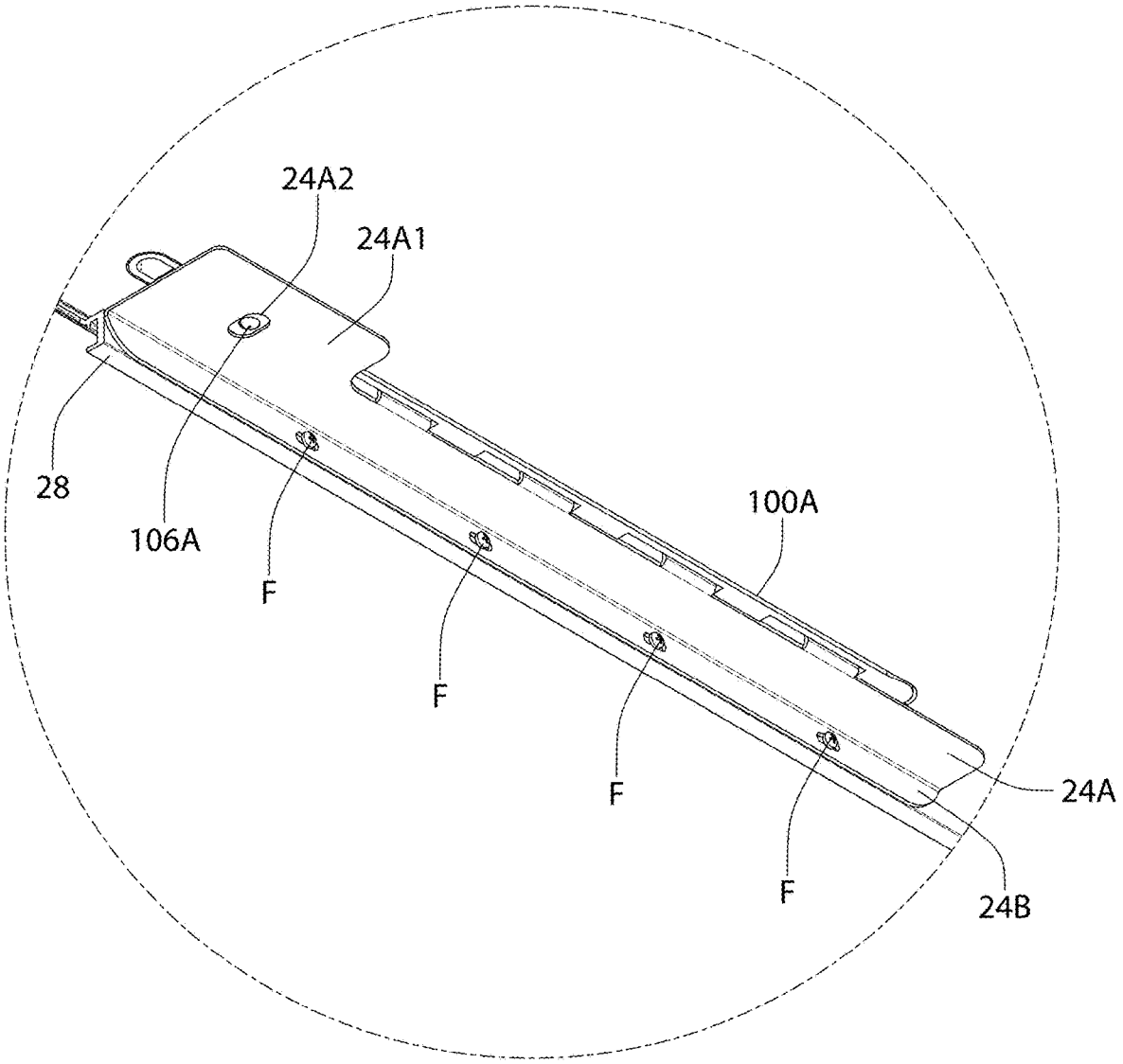
FIG. 4 is an enlarged isometric view of the left cantilever bracket installed on a cubicle wall.

As shown most clearly in FIGS. 3-4, the LSSB 24 comprises a horizontal flange 24A and a vertical flange 24B. The horizontal flange 24A comprises an extension 24A1 with an aperture 24A2. Vertical flange 24B comprises a plurality of apertures to receive fasteners (e.g., screws) therethrough for securing the LSSB 24 to the cubicle wall CW1. The top side of the horizontal flange 24A comprises a plurality (e.g., four) L-shaped projections P1-P4 (see FIG.

8) which are configured to fit into the corresponding chambers CH1-CH4 in receptacle bracket 100A.

With the left-side 22F of desktop element 22 is positioned over the LSSB 24 and the projections P1-P4 inserted into the respective chambers CH1-CH4, when the desktop element 22 is slid back (away from the wall CW2, towards the installer), the release button 106A slides over the extension 24A1. As the sliding motion continues, the release button 106A finally seats itself into the aperture 24A2, thereby releasably locking that side of the desktop element 22 into the LSSB 24.

Figure 5:
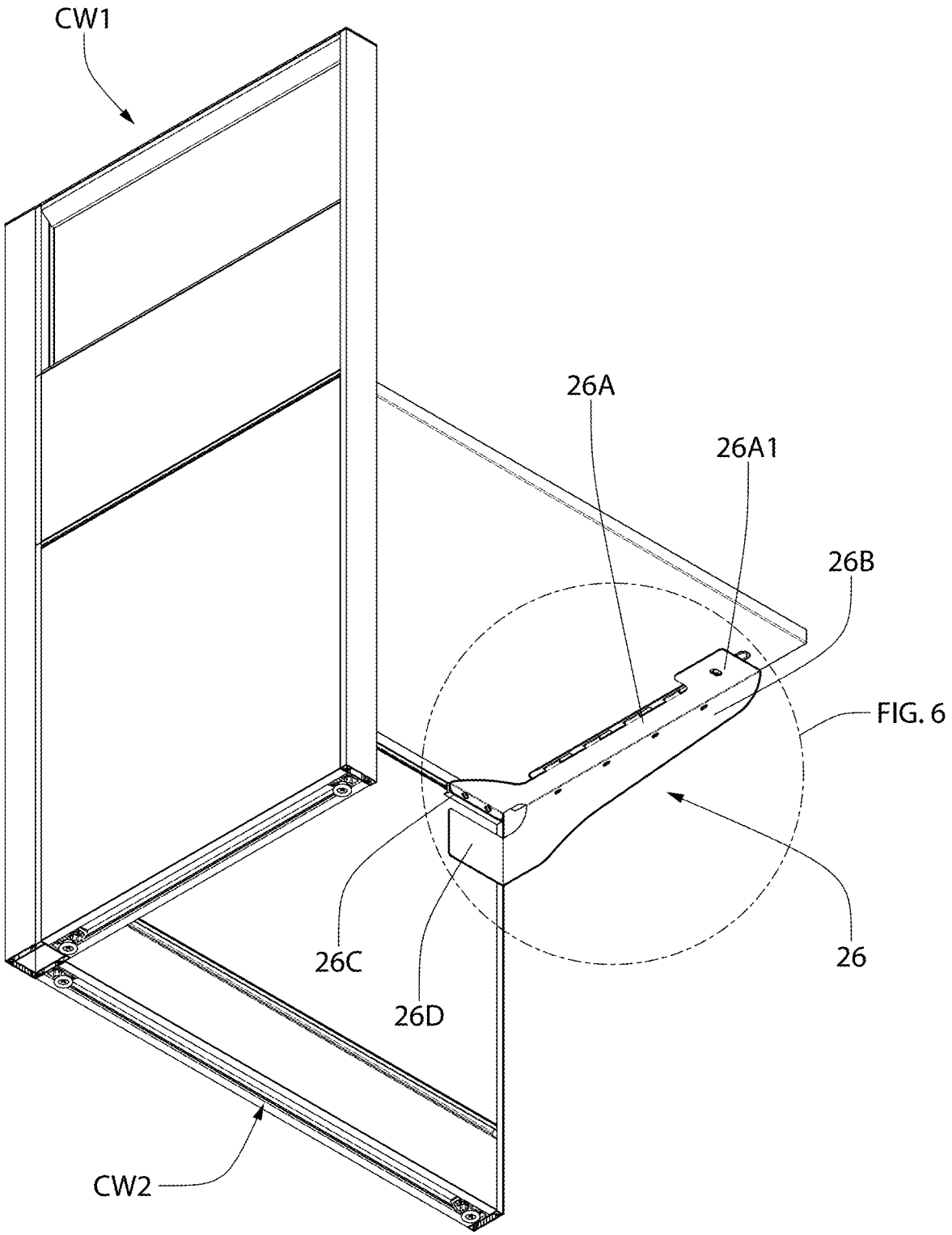
FIG. 5 is a bottom isometric view of the right underside of the inventive releasable desktop apparatus of FIG. 2 with the desktop element positioned therein and locked in place.
Figure 6:
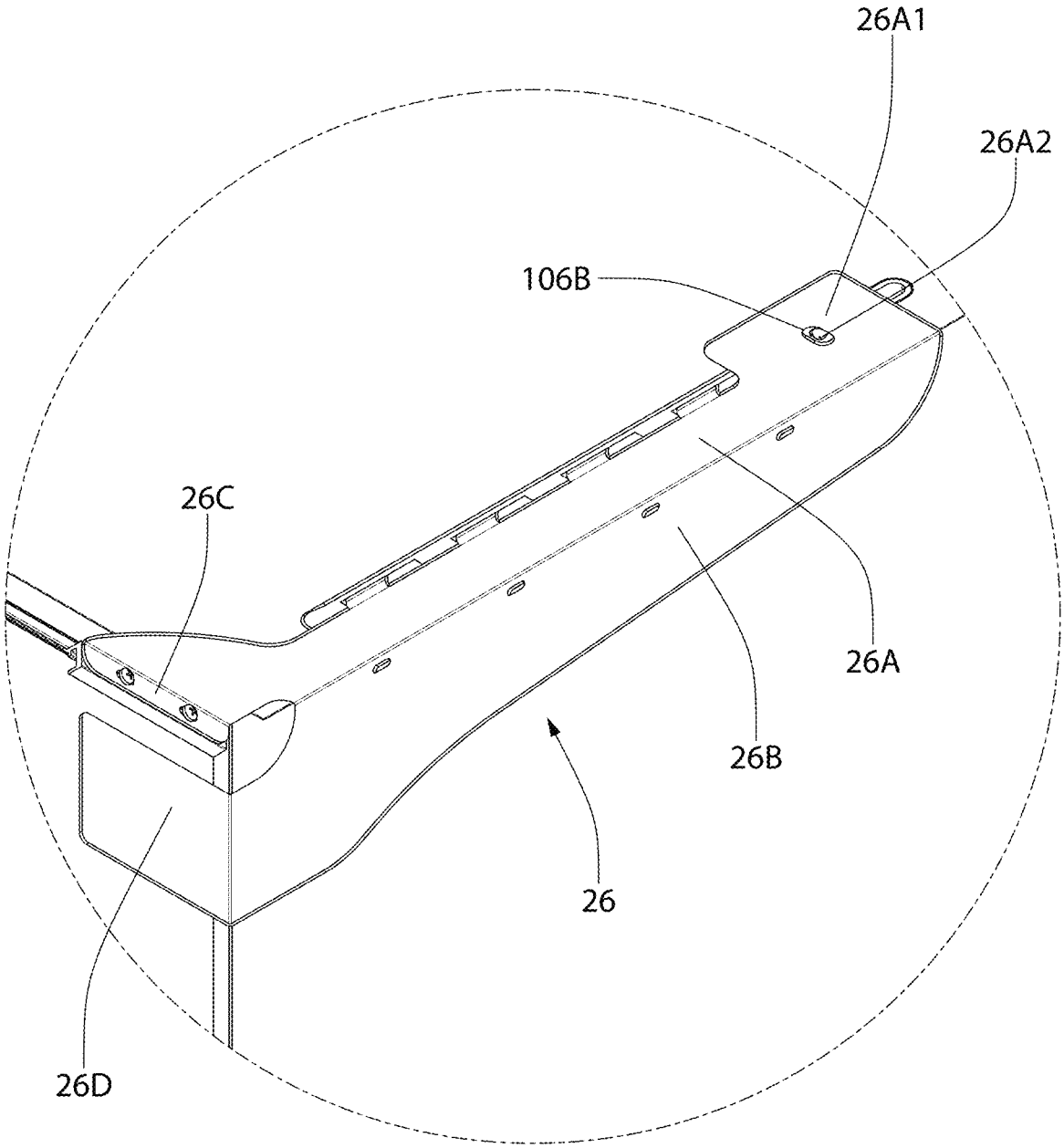
FIG. 6 is an enlarged isometric view of the right-side support bracket installed on another cubicle wall.

The details of the RSSB 26 are shown in FIGS. 5-6. The bracket 26 also comprises a horizontal flange 26A and a vertical flange 26B. In addition, since the RSSB 26 is positioned at the "open" right side 22G of the desktop element 22, the RSSB 24 forms a "cantilever" bracket in that the RSSB 24 is attached only at one end to the cubicle wall CW2. The releasable securement of the RSSB 26 to the cubicle wall CW2 is implemented via a perpendicular forward portion comprising an upper vertical flange 26C and a lower vertical flange 26D. Upper vertical flange 26C downwardly depends from the horizontal flange 26A whereas lower vertical flange 26D is a perpendicular extension of the vertical flange 26B. As with the LSSB 24, the horizontal flange 26A comprises an extension 26A1 with an aperture 26A2. When the right-side 22G of desktop element 22 is positioned over the RSSB 26 and the projections P1-P4 inserted into the respective chambers CH1-CH4, when the desktop element 22 is slid back (away from the wall CW2, towards the installer), the release button 106B slides over the extension 26A1. As the sliding motion continues, the release button 106B finally seats itself into the aperture 24A2, thereby releasably locking that side of the desktop element 22 into the RSSB 26.

The following discussion is related to releasably mounting the LSSB 24 and the RSSB 26 to respective cubicle walls CW1 and CW2 that form a corner (again, by way of example only) in the modular business cubicle MBC.

Figure 7:
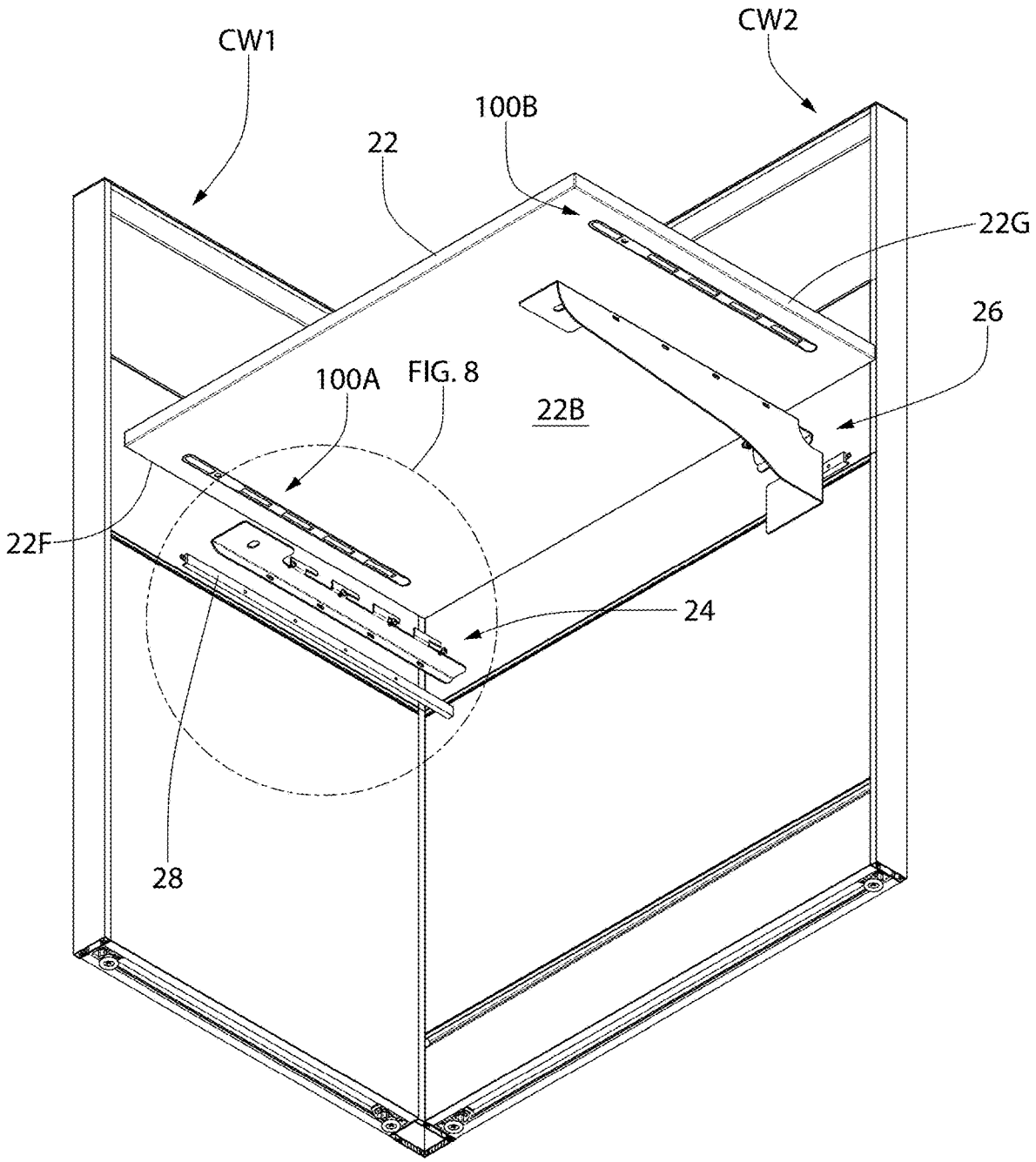
FIG. 7 is a bottom isometric view the invention with the left-side and right-side support brackets and their couplings to respective cubicle walls shown in an exploded view.
Figure 8:
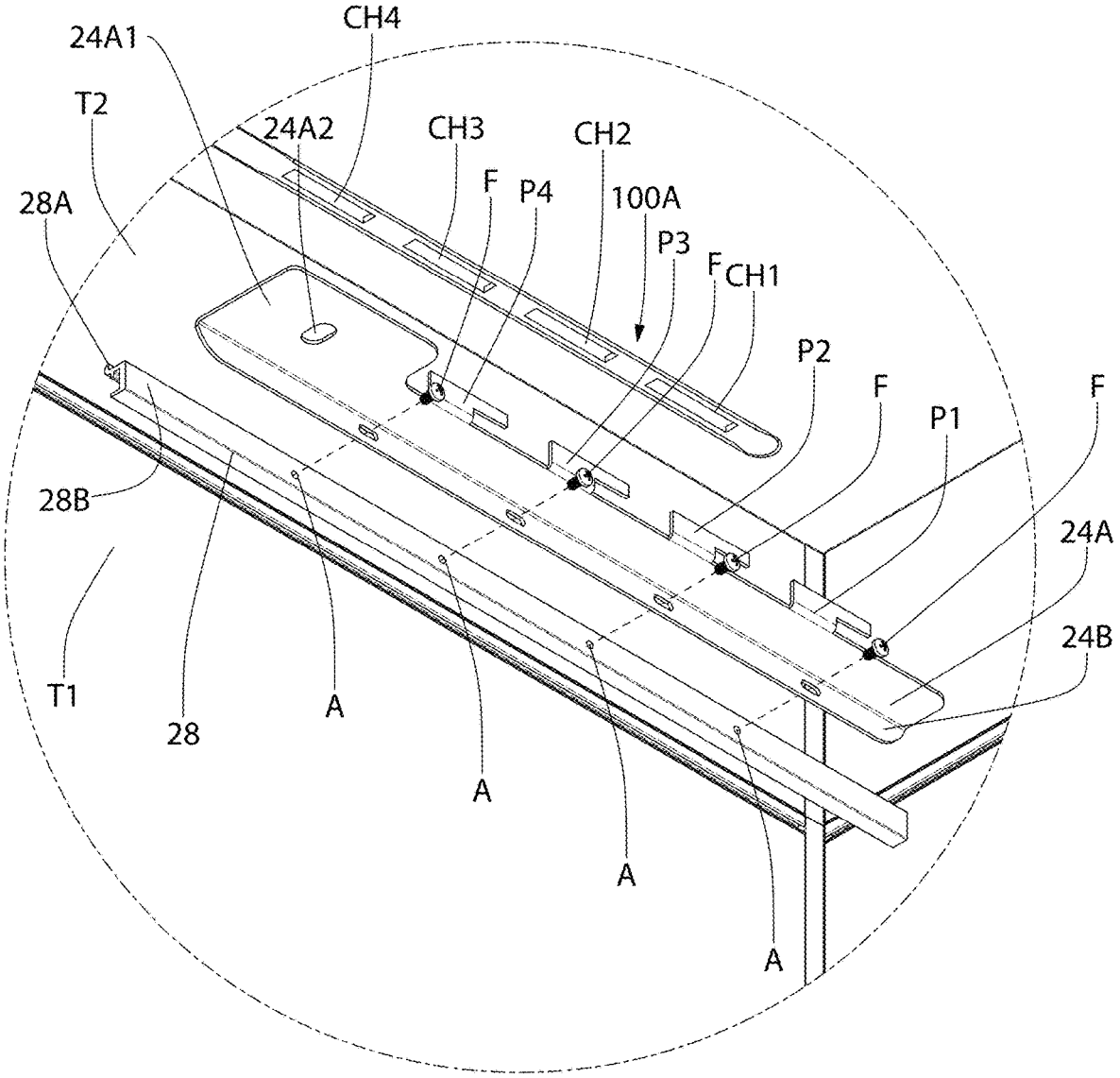
FIG. 8 is an enlarged exploded view of the left-side support bracket and its couplings to a cubicle wall.

As shown most clearly in FIG. 7, a C-shaped mounting bracket 28 is used to secure the LSSB 24. In particular, the C-shaped mounting bracket 28 has a lip 28A (FIG. 8) that is inserted in between two vertically-connected tiles T1/T2. With that lip 28A trapped between the two tiles T1/T2, the C-shaped mounting bracket 28 provides a "standoff surface" 28B for receiving fasteners F (e.g., screws) therethrough. As shown in FIG. 8, the standoff surface 28B comprises a plurality of apertures A. When the LSSB 24 is to be secured to the cubicle wall CW1, oval-shaped apertures OA in the vertical flange 24B are aligned with the bracket apertures A and the fasteners F secured therein. The oval-shaped apertures OA allow for horizontal adjustment of the LSSB 24.

Figure 9:
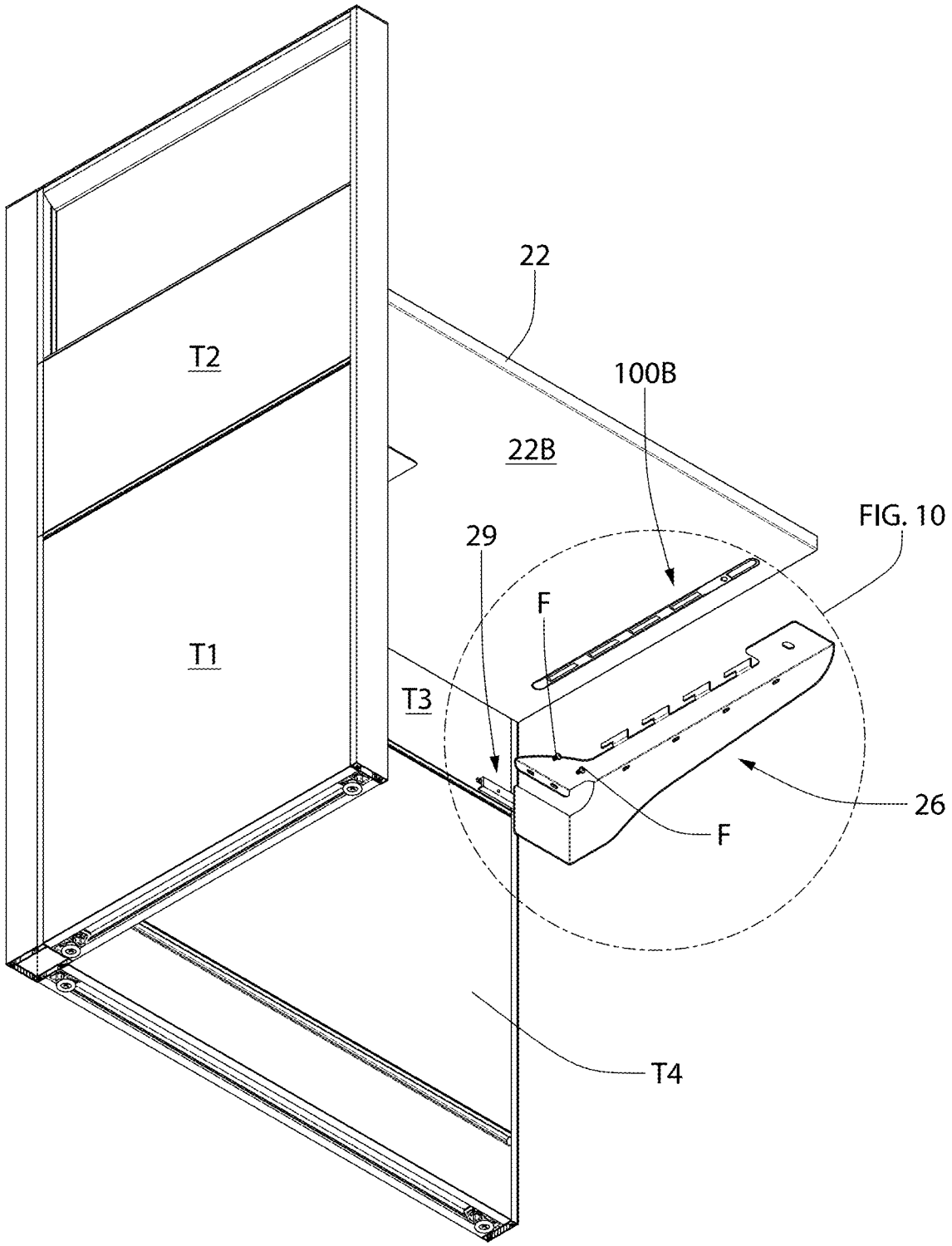
FIG. 9 is a bottom isometric view of the invention with the right-side support bracket and its couplings to a cubicle wall shown in an exploded view.
Figure 10:
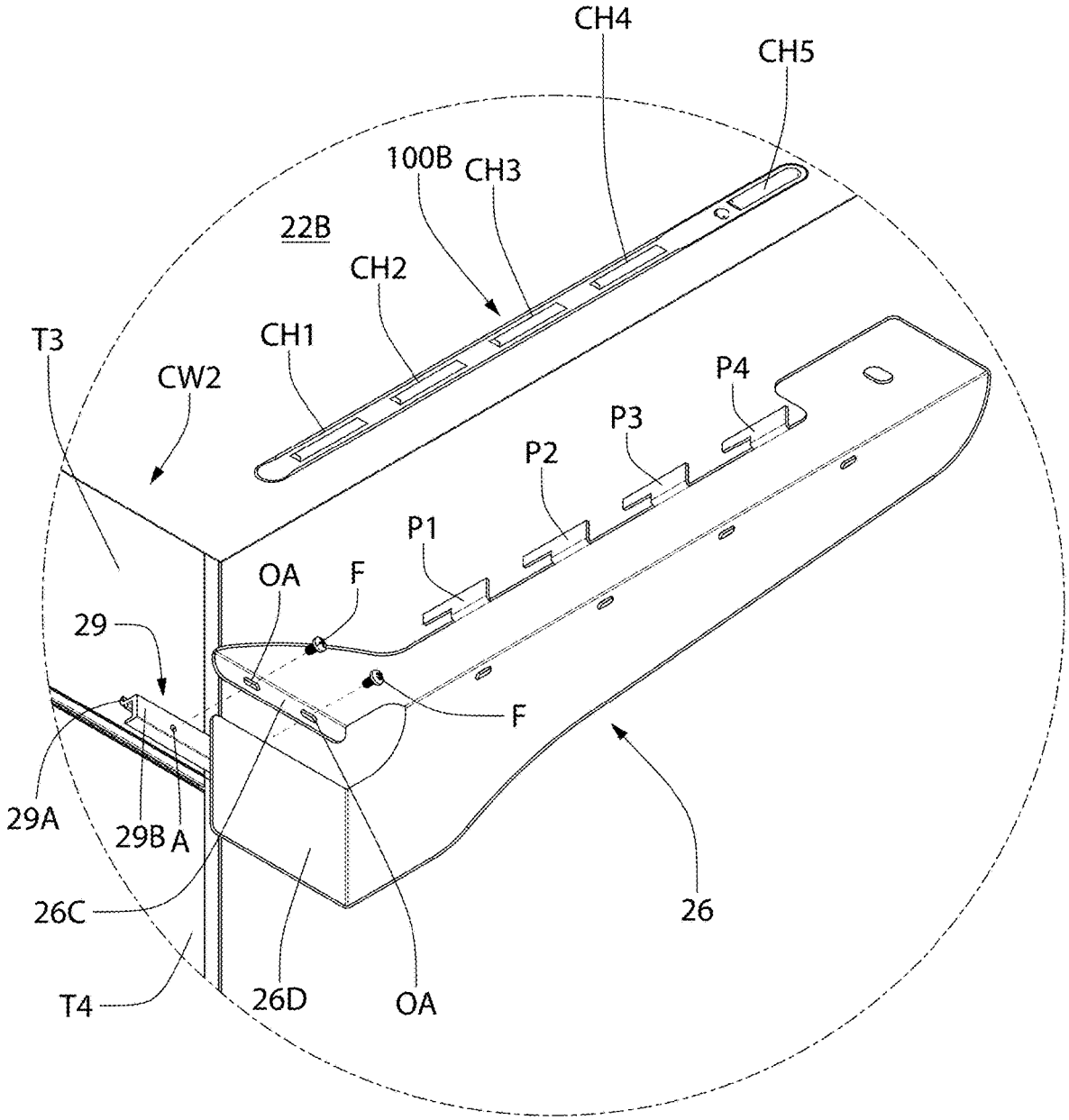
FIG. 10 is an enlarged exploded view of the right-side support bracket and its couplings to a cubicle wall.
Figure 11:
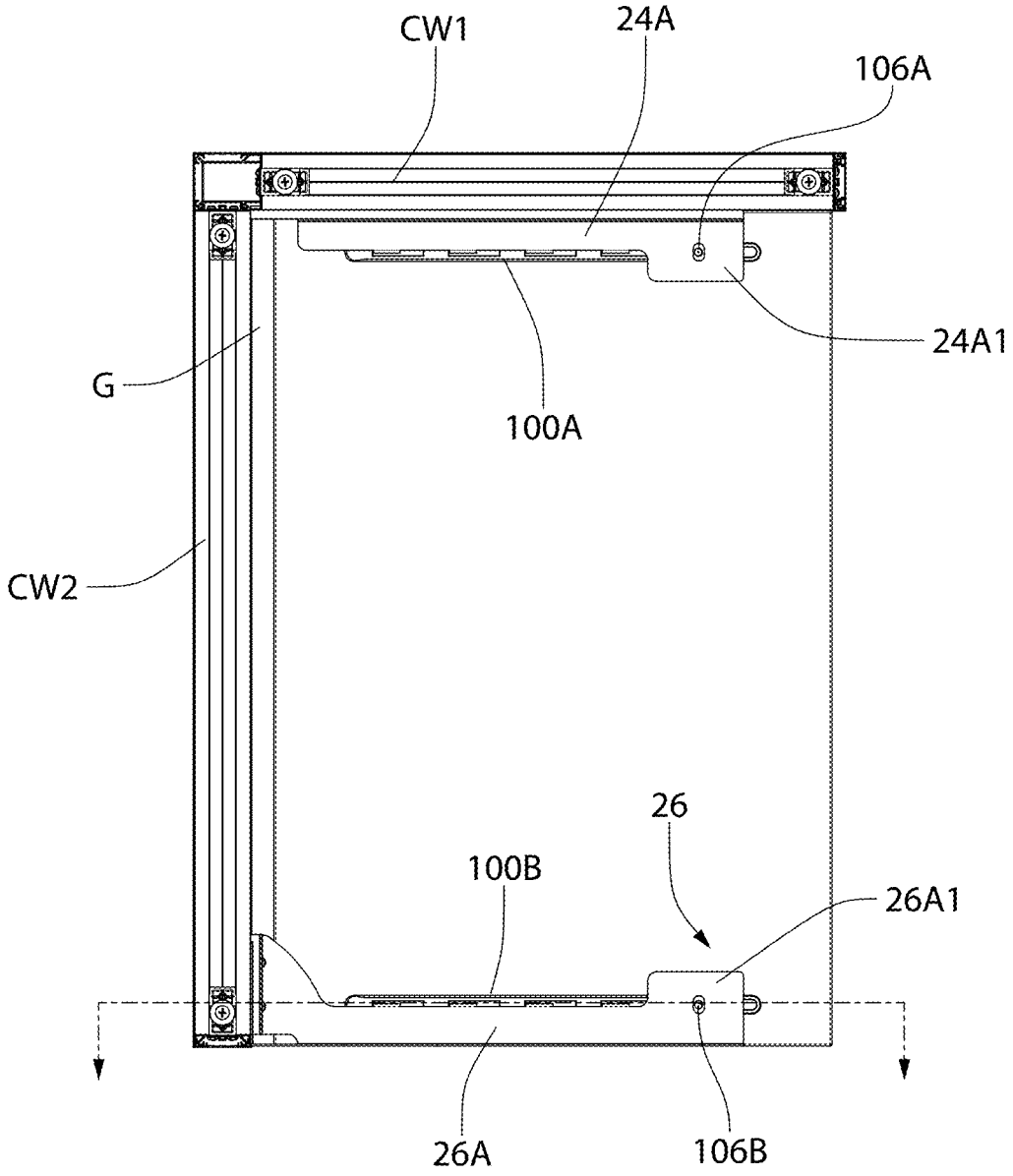
FIG. 11 is a bottom plan view of the inventive releasable desktop apparatus of FIG. 2 with the desktop element positioned therein and locked in place.
Figure 12:
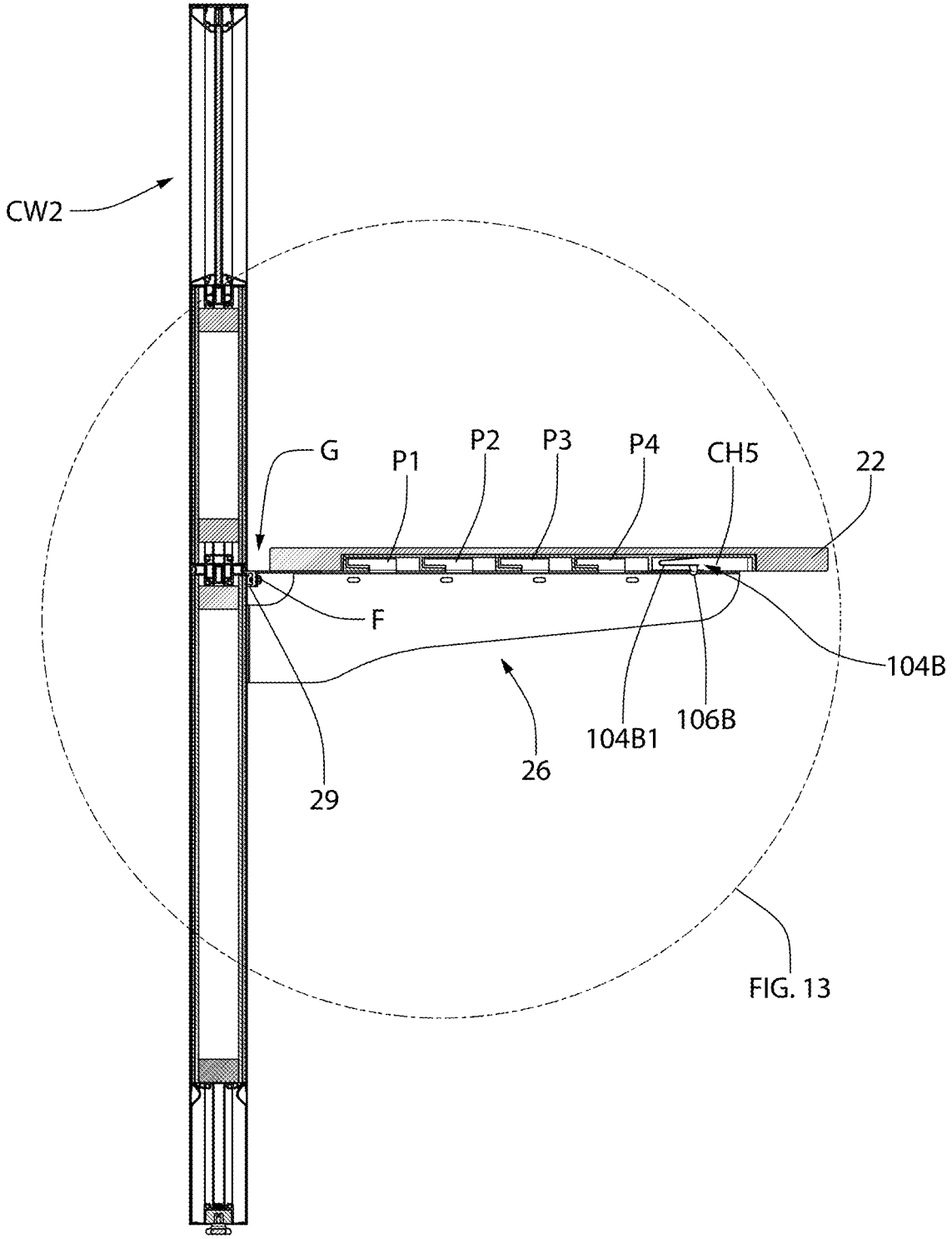
FIG. 12 is a cross-sectional view of the right-side support bracket locked into the right receptacle bracket of the desktop element taken along line 12-12 of FIG. 11.
Figure 13:
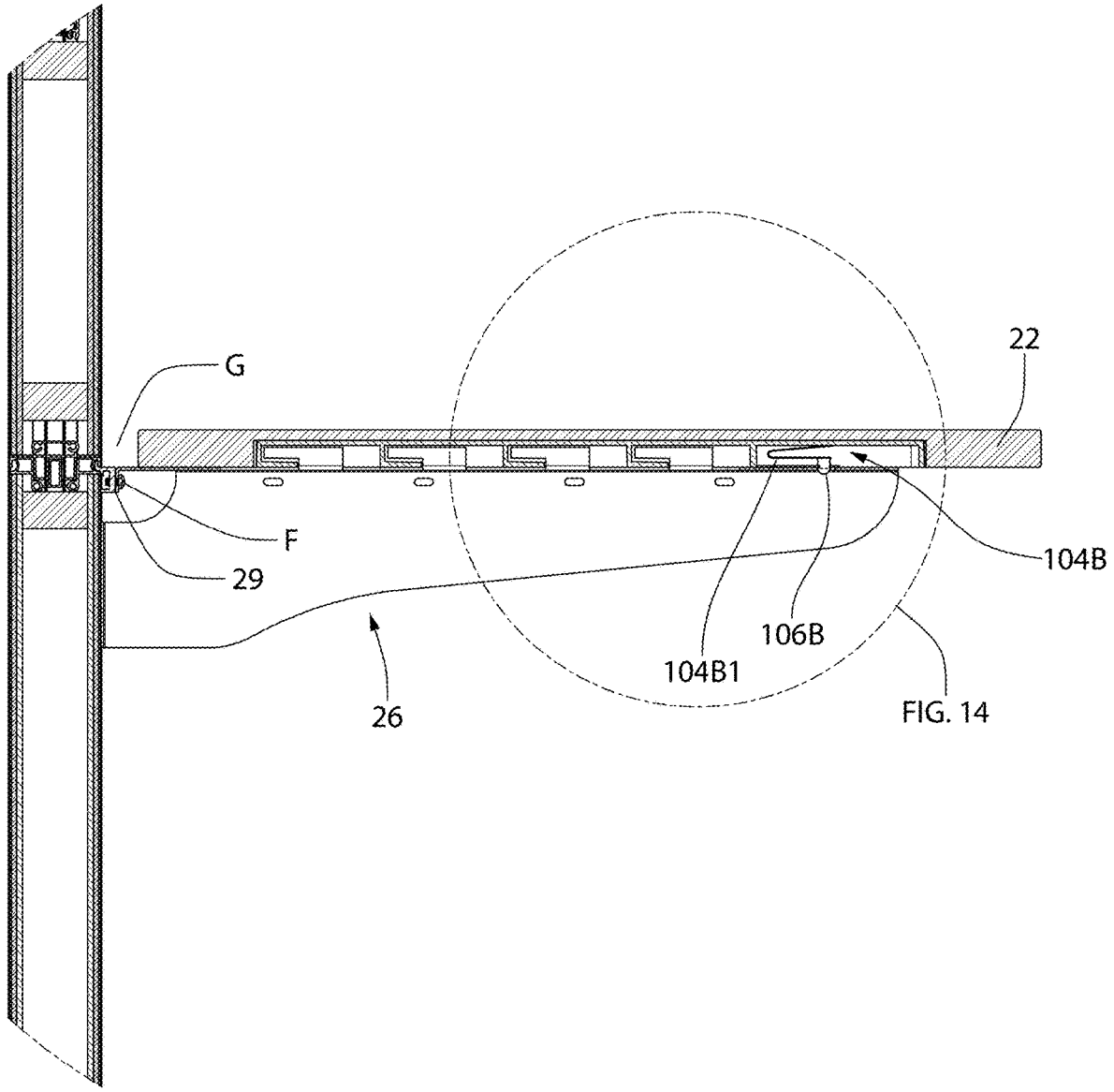
FIG. 13 is an enlargement of the circled portion of the inventive releasable desktop apparatus of FIG. 12.
Figure 14:
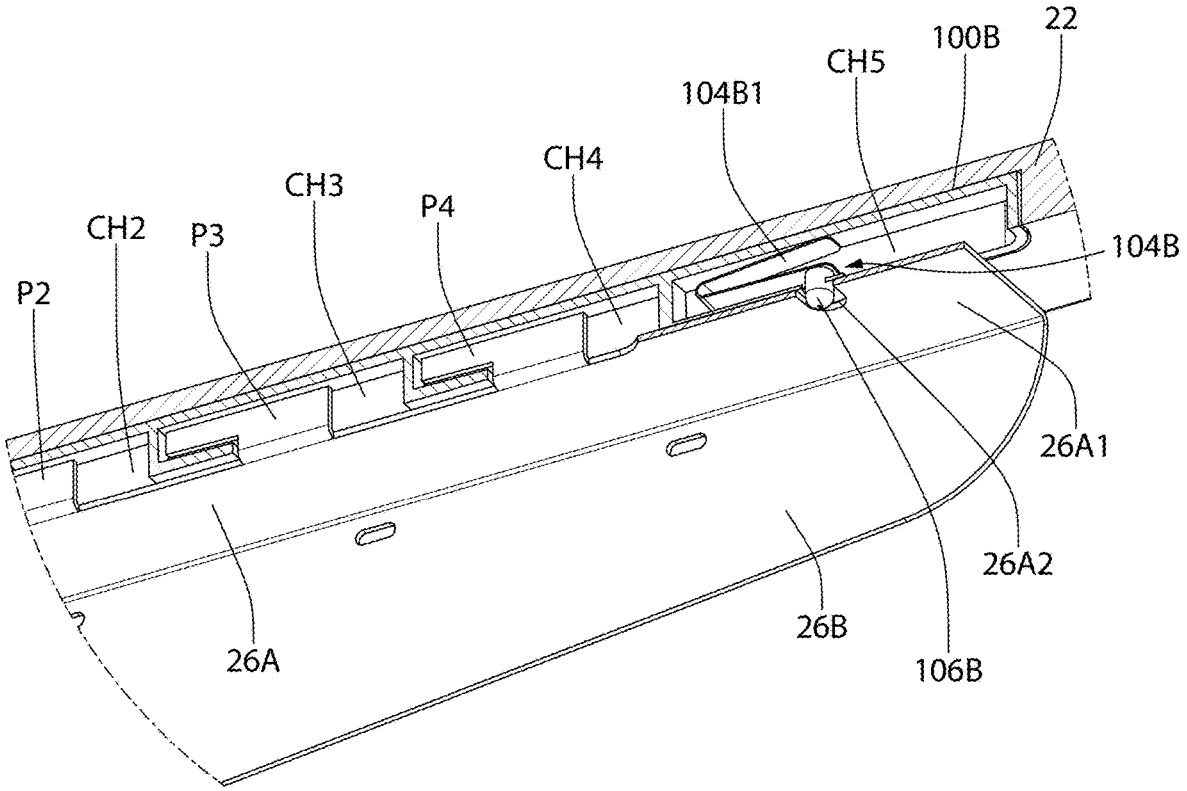
FIG. 14 is a partial cross-sectional isometric view of the right-side support bracket locked into the right receptacle bracket of the desktop element.
Figure 15:
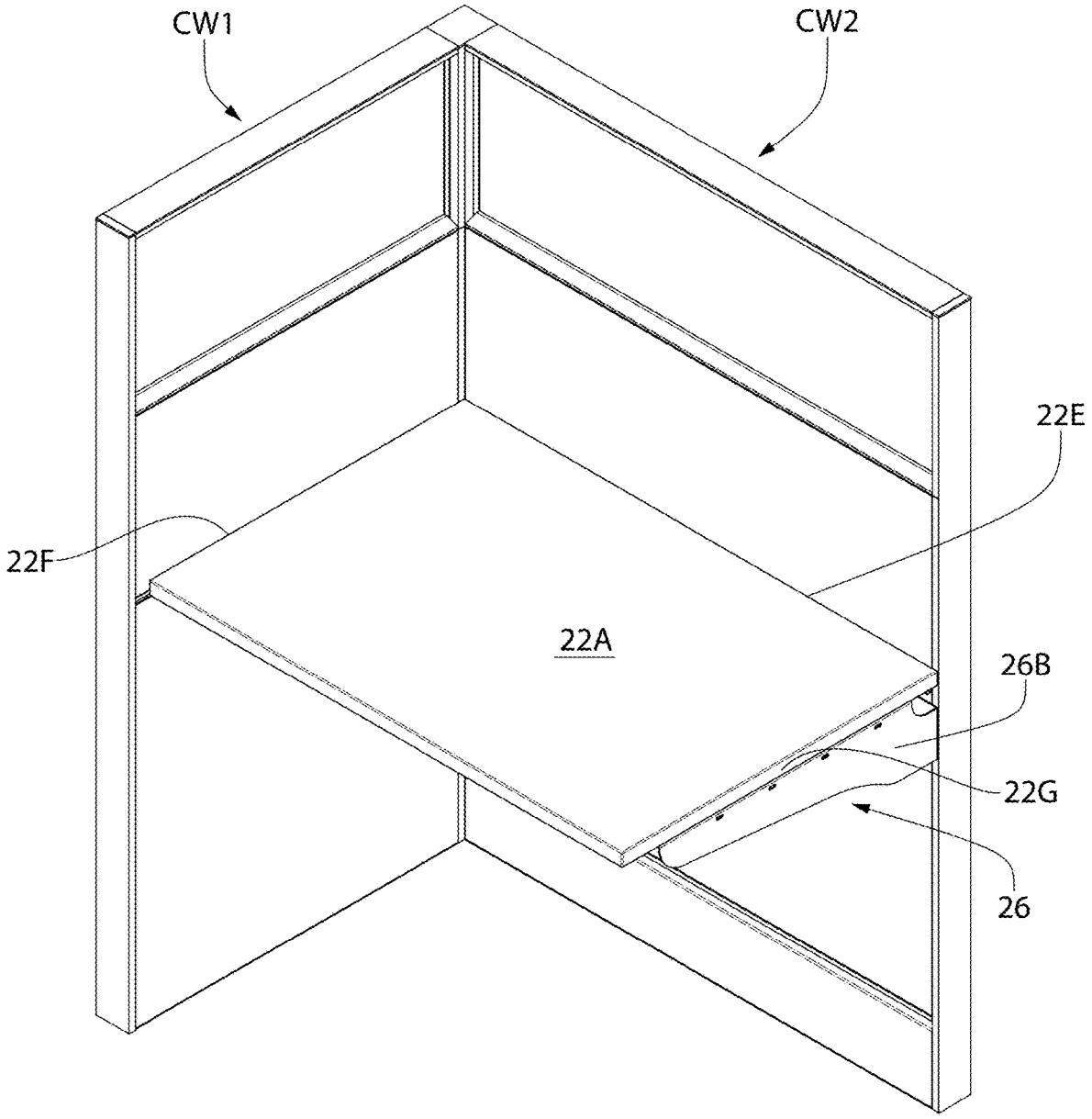
FIG. 15 is a top isometric view of an inside corner of the modular business cubicle showing the inventive releasable desktop apparatus with the desktop element positioned therein and not yet locked in place.
Figure 16:
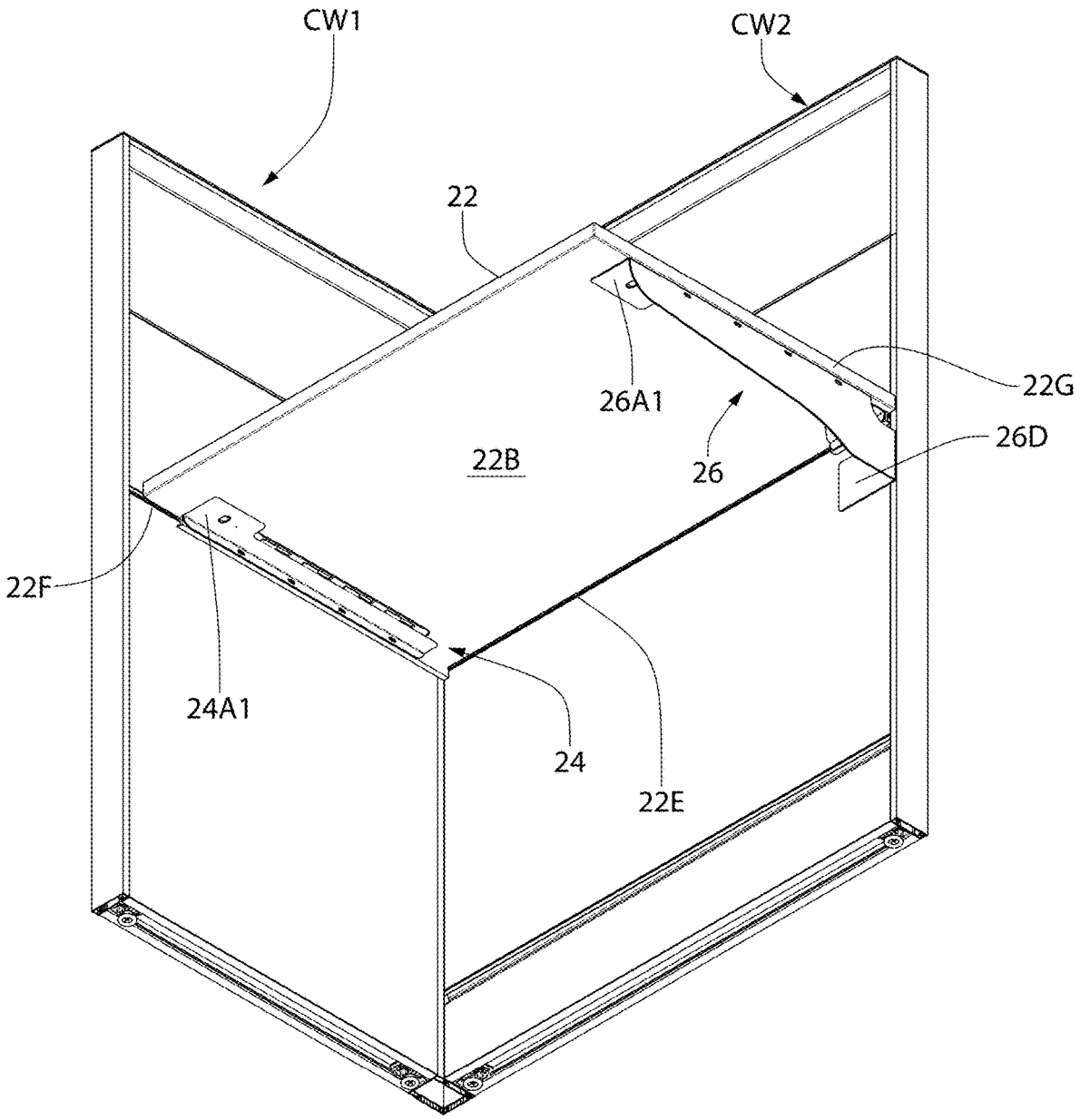
FIG. 16 is a bottom isometric view of an inside corner of the modular business cubicle showing the inventive releasable desktop apparatus of FIG. 2 with the desktop element positioned therein and not yet locked in place.
Figure 17:
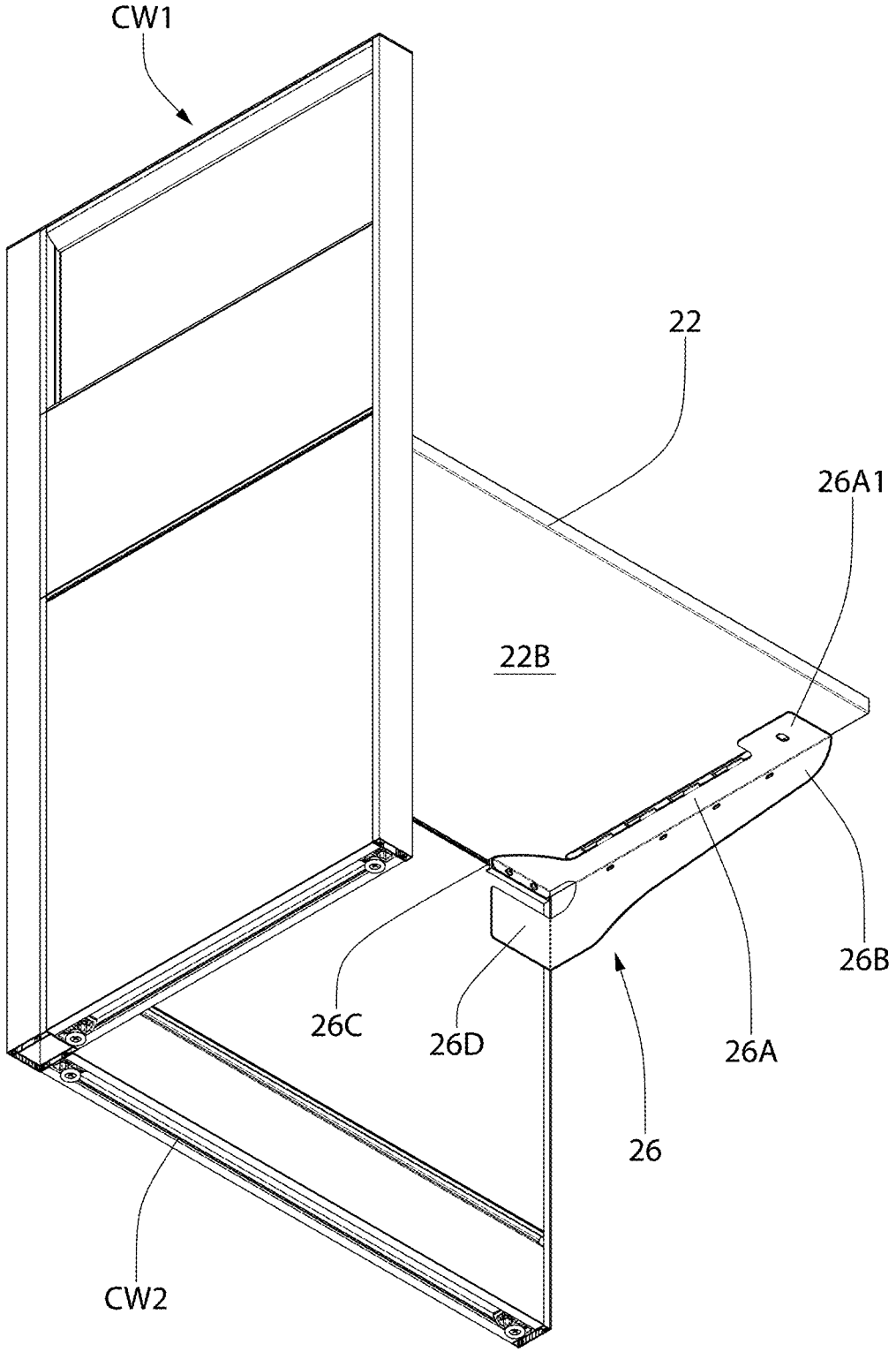
FIG. 17 is a bottom isometric view of the right underside of the inventive releasable desktop apparatus of FIG. 15 with the desktop element positioned therein and not yet locked in place.
Figure 18:
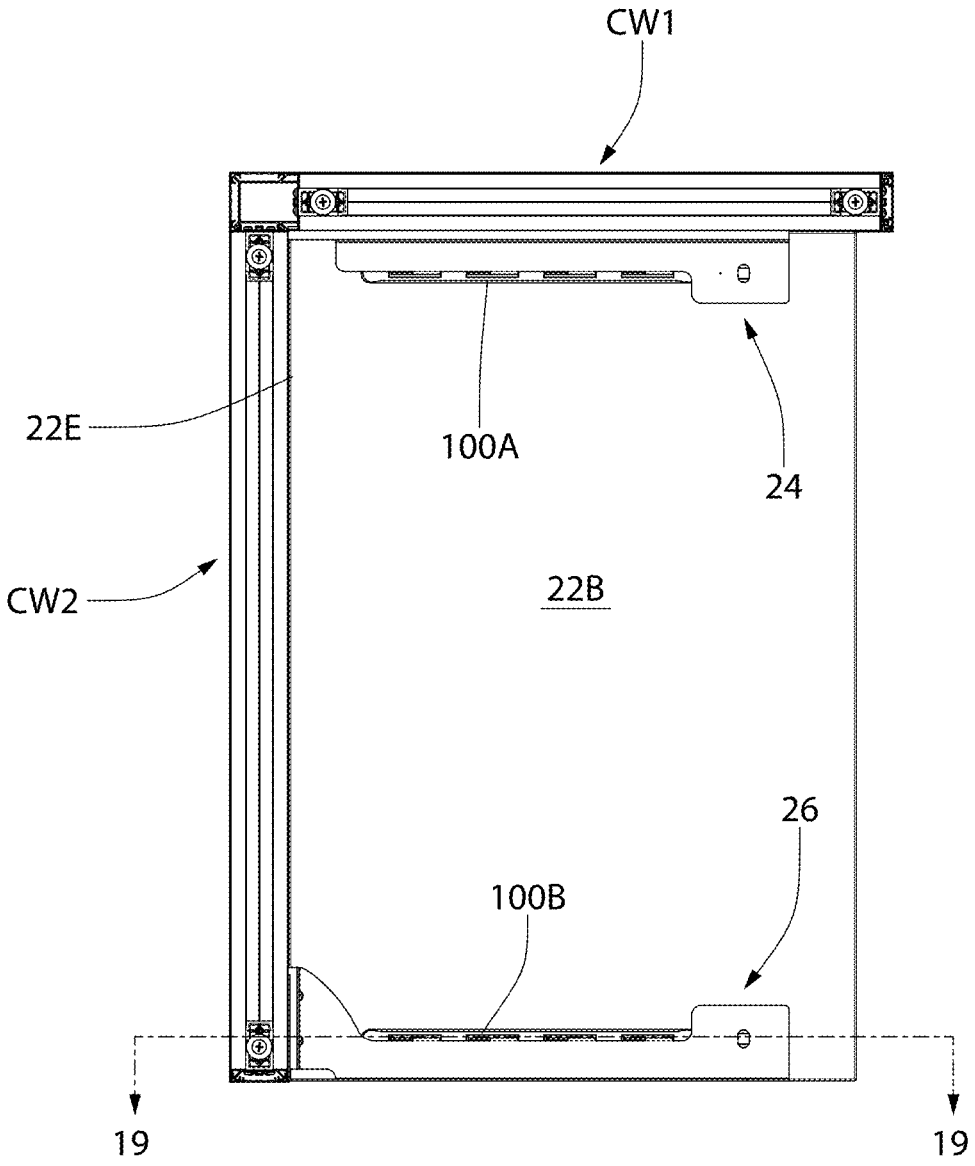
FIG. 18 is a bottom plan view of the inventive releasable desktop apparatus of FIG. 15 with the desktop element positioned therein and not yet locked in place.
Figure 19:
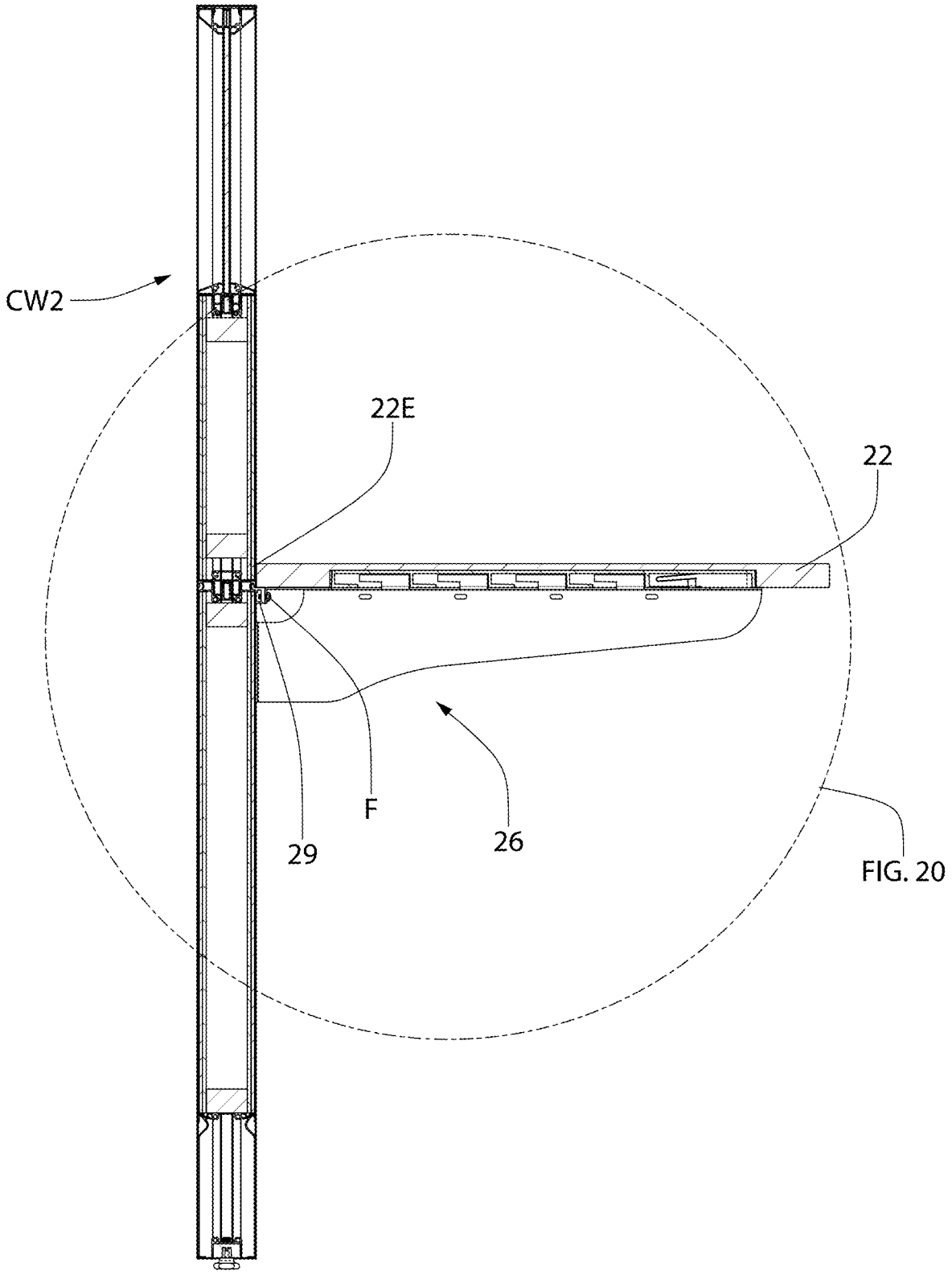
FIG. 19 is a cross-sectional view taken along line 19-19 of FIG. 18 of the right-side support bracket connected to the right receptacle bracket but not yet locked in place.
Figure 20:
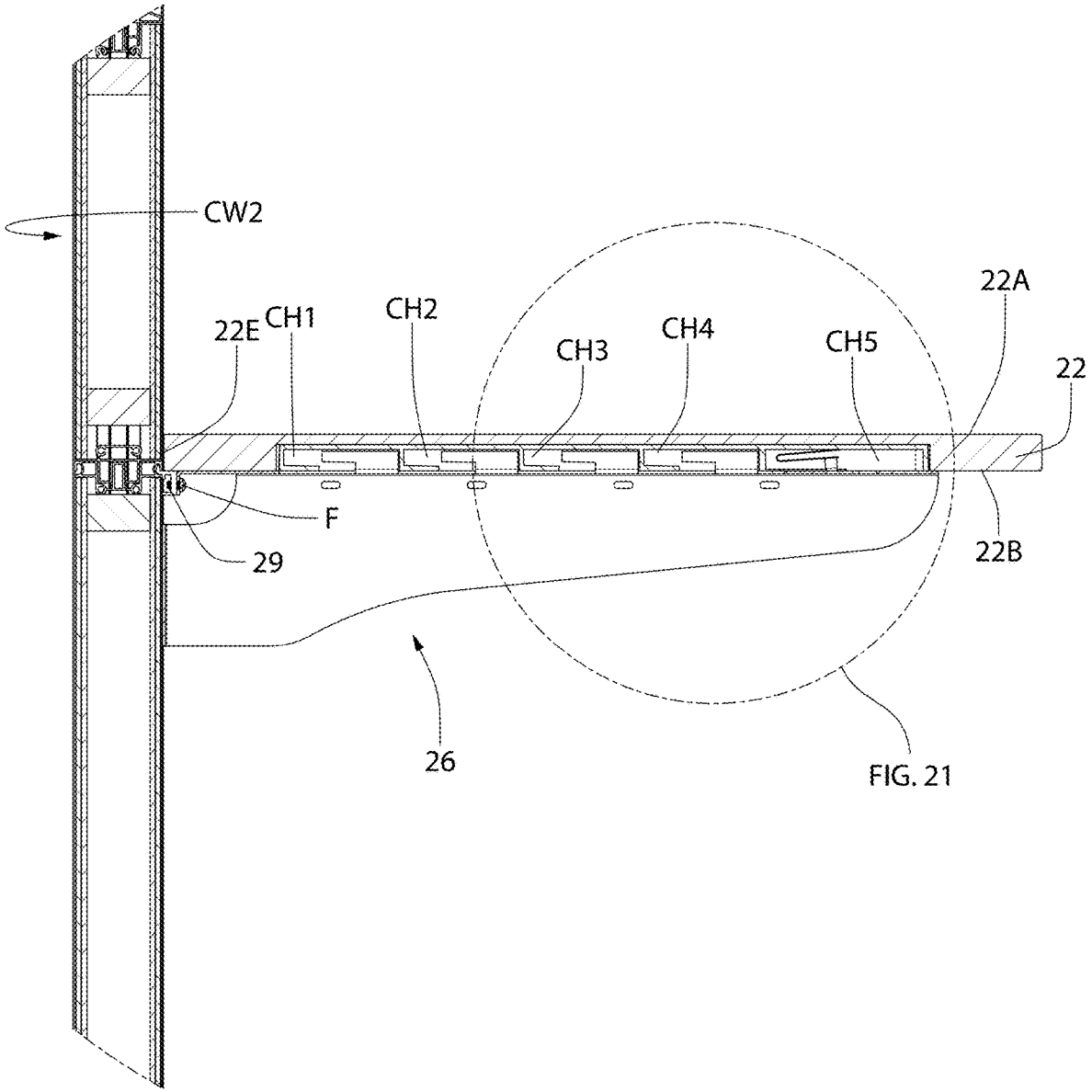
FIG. 20 is an enlargement of the circled portion of FIG. 19 showing the right receptacle bracket coupled with the right-side support bracket but not yet locked in place.

As shown most clearly in FIG. 9, a shorter C-shaped mounting bracket 29 is used to secure the RSSB 26. In particular, the C-shaped mounting bracket 29 also has a lip 29A (FIG. 10) that is inserted in between two vertically-connected tiles T3/T4. With that lip 29A trapped between the two tiles T3/T4, the C-shaped mounting bracket 29 also provides a "standoff surface" 29B for receiving fasteners F (e.g., screws) therethrough. As shown in FIG. 10, the standoff surface 29B comprises a plurality of apertures A. When the RSSB 26 is to be secured to the cubicle wall CW2, oval-shaped apertures OA in the upper vertical flange 26C are aligned with the bracket apertures A and the fasteners F secured therein. The oval-shaped apertures OA allow for horizontal adjustment of the RSSB 26. Furthermore, the lower vertical flange 26D acts to transfer the loading applied to the desktop element 22 on the right side thereof to the cubicle wall CW2.

To releasably secure the desktop element 22 to the LSSB 24 and the RSSB 26 once those two brackets are secured to the cubicle walls CW1 and CW2, the user/operator will position the bottom side 22B of the desktop element 22 over the two brackets 24/26 with the forward end 22E of the desktop element 22 up against the cubicle wall CW2, as shown in FIGS. 15-21. With the forward end 22E of the desktop element 22 against the cubicle wall CW2, the user/operator will seat all of the L-shaped prongs P1-P4 of both brackets 24/26 into corresponding chambers CH1-CH4 of the receptacle brackets 100A/100B in the bottom side 22B of the desktop element 22. At that point, the release buttons 106A/106B are compressed upward since the extensions 24A1 and 26A1 are compressing the release devices 104A/104B in the receptacle brackets 100A/100B. The user/operator then pulls back on the desktop element 22, thereby moving the forward edge 22E away from the cubicle wall CW2 and this backward movement causes the release buttons 106A/106B to seat themselves in the respective apertures 24A2/26A2 of the cantilever brackets 24/26, thereby releasably securing the desktop element 22 on the two support brackets 24/26. In doing so, a gap G is created between the forward edge 22E of the desktop element 22 and the cubicle wall CW2, as shown in FIGS. 2-3 and 11-14. An elongated tray (not shown) can be inserted into the gap G to prevent writing implements or other items from falling over the forward edge 22E and onto the floor.

Conversely, to disengage the desktop element 22 from the two support brackets 24/25, the user would depress the release buttons 106A/106B upward and then slide the desktop element 22 forward (so that forward edge 22E contacts wall CW2) and then lift the desktop element 22 upward to disengage the desktop element 22 from the support brackets 24/26.

FIG. 26 depicts the desktop apparatus 20 releasably mounted on a cubicle wall (formed by two serial cubicle walls CW2 and CW3). Since there is no "corner" in this mounting, the left-side support bracket requires a cantilever structure, similar to RSSB 26. As such, the left-side support bracket 124 is a "mirror" structure of RSSB 26 but for use on the left side 22F of the desktop element 22. In particular LSSB 124 comprises a horizontal flange 124A and a vertical flange 124B. In addition, since the left side 22F of the desktop element 22 is now also "open", releasable securement of the cantilever LSSB 124 is implemented vial a perpendicular forward portion comprising an upper vertical flange 124C and a lower vertical flange 124D. Although not clearly shown, a C-shaped mounting bracket, having an upper lip and "standoff surface", similar to the C-shaped mounting bracket 29 used with the RSSB 26, is used along with fasteners to releasably couple the LSSB 124 to the cubicle wall.

It should be further noted that if the desktop element 22 were to be releasably positioned in the modular cubicle MBC such that the right side 22G of the desktop element 22 were located in a cubicle corner, then a "mirror" bracket of LSSB 24 would be used to engage with receptacle bracket 100B to releasably secure the right side 22G within that cubicle corner and the LSSB 124 would be used to engage with receptacle bracket 100A to releasably secure the left side 22F of the desktop element 22 at that corner of the cubicle MBC.

While the invention has been described in detail and with reference to specific examples thereof, it will be apparent to one skilled in the art that various changes and modifications can be made therein without departing from the spirit and scope thereof.

What is claimed is:

1. A releasable desktop apparatus for use in a modular cubicle formed of a plurality of tiles, some of which are vertically connected, to form at least one wall of the modular cubicle, said releasable desktop apparatus comprising:

a desktop element having a pair of receptacle brackets inserted on opposite edges of a bottom side of said desktop element, each of said receptacle brackets comprising a plurality of chambers;

a first support bracket that releasably secures to the at least one wall, and a second support bracket that releasably secures to the at least one wall, each of said first and second support brackets comprising a plurality of projections corresponding to said plurality of chambers in said receptacle brackets; and a respective release device positioned within each receptacle bracket and each comprising a release button, each of said release buttons configured to ride along a respective horizontal flange of said first and second support brackets when said plurality of projections are inserted within said plurality of chambers in said desktop element and said desktop element is moved until said release buttons encounter and seat within a respective aperture within said respective horizontal flanges, thereby releasably locking said desktop to said first and second support brackets.

2. The releasable desktop apparatus of claim 1 wherein said plurality of chambers are serially aligned and wherein said plurality of projections are serially aligned.

3. The releasable desktop apparatus of claim 2 wherein said release device is positioned within a chamber that is the farthest from a front edge of said desktop element.

4. The releasable desktop apparatus of claim 1 wherein each of said release devices comprises a V-shaped leaf spring, with one member of the V-shaped leaf spring secured within the receptacle bracket and another member of the V-shaped leaf spring being free to move up and down and comprises said release button positioned on an end of said other member.

5. The releasable desktop apparatus of claim 1 wherein said first support bracket and said second support bracket are releasably secured the at least one wall of the cubicle using a respective C-shaped mounting bracket, each of said C-shaped mounting brackets comprising an upper lip that is configured to become lodged between two vertically-positioned tiles.

6. The releasable desktop apparatus of claim 5 wherein said first support bracket and said second support bracket are releasably secured to a standoff surface of said respective C-shaped mounting brackets using fasteners.

7. The releasable desktop apparatus of claim 1 wherein said plurality of projections comprises L-shaped projections.

8. The releasable desktop apparatus of claim 1 wherein said pair of pair of receptacle brackets are embedded within said desktop element so that said plurality of chambers are flush with said one side of said desktop element.

9. The releasable desktop apparatus of claim 1 wherein the at least one wall comprises two perpendicular walls to form a corner of said modular cubicle and wherein one of said opposite edges of said desktop element is positioned to be parallel to one of said two perpendicular walls and wherein said first support bracket is releasably coupled along its length to the one of said two perpendicular walls.

10. The releasable desktop apparatus of claim 9 wherein the other one of said opposite edges of said desktop element is positioned to be perpendicular to the other one of said two perpendicular walls and wherein one end of said second support bracket is releasably coupled to the other one of said two perpendicular walls.

11. A method for making a desktop element releasably lockable in a modular cubicle formed of a plurality of tiles, some of which are vertically connected, to form at least one cubicle wall, said method comprising:

forming a desktop element having a pair of receptacle brackets inserted on opposite edges of a bottom side of said desktop element, each of said receptacle brackets comprising a plurality of chambers, each of said receptacle brackets including a respective release device having a release button that can move up and down;

forming a first and a second support bracket each comprising a plurality of projections corresponding to said plurality of chambers in said receptacle brackets and each support bracket comprising a horizontal flange with an aperture therein;

releasably securing said first support bracket and said second support bracket to the at least one wall;

positioning said desktop element such that said plurality of projections of said first and second support brackets are aligned with said plurality of chambers in said pair of receptacle brackets and pressing said desktop element downward to have said plurality of projections enter said plurality of chambers; and pulling said desktop element towards the user to cause said release buttons to seat within respective apertures in said respective horizontal flanges of said first and second support brackets and thereby releasably lock said desktop element to said first and second support brackets.

12. The method of claim 11 wherein said step of forming said desktop element comprises forming said plurality of chambers to be serially aligned and wherein said step of form said first and second cantilever brackets comprises forming said plurality of projections to be serially aligned.

13. The method of claim 12 wherein said step of forming said desktop element comprises positioning said release device within a chamber in said receptacle bracket that is the farthest from a front edge of said desktop element.

14. The method of claim 11 wherein said step of forming said desktop element comprises inserting a respective V-shaped leaf spring within each receptacle bracket to form said release device, said step of inserting comprising securing one member of said V-shaped leaf spring within said receptacle bracket and allowing another member of said V-shaped leaf spring to move freely up and down and wherein said release button is positioned on an end of said other member.

15. The method of claim 14 wherein said step of releasably securing said first cantilever bracket to said first wall comprises initially positioning respective C-shaped mounting brackets to respective walls of the corner of the cubicle, and wherein each of said C-shaped mounting brackets comprises an upper lip that is lodged between two vertically-positioned tiles of said respective cubicle walls.

16. The method of claim 15 wherein said step of releasably securing said first cantilever bracket to said first wall comprises releasably securing said first cantilever bracket and said second cantilever bracket to a respective standoff surface of said respective C-shaped mounting brackets using fasteners.

17. The method of claim 11 wherein said plurality of projections comprises L-shaped projections.

18. The method of claim 11 wherein said step of forming said desktop element comprises embedding said receptacle brackets within the desktop element so that said plurality of chambers are flush with said one side of said desktop element.

19. The method of claim 11 further comprising the step of releasing said desktop element from said first and second cantilever brackets, said step of releasing said desktop element comprising:

(a) depressing said release buttons upward;

(b) sliding said desktop element forward; and (c) raising said desktop element off of said first and second cantilever brackets.

20. The method of claim 11 wherein the at least one wall comprises two perpendicular walls to form a corner of said modular cubicle and wherein said step of releasably securing said first support bracket comprises positioning one of said opposite edges of said desktop element to be parallel to one of said two perpendicular walls and releasably coupling said first support bracket along its length to the one of said two perpendicular walls.

21. The method of claim 20 wherein said step of releasably securing said second support bracket comprises positioning the other one of said opposite edges of said desktop element to be perpendicular to the other one of said two perpendicular walls and releasably coupling one end of said second support bracket to the other one of said two perpendicular walls.

* * * * *